US009291161B2

(12) United States Patent
Hogan et al.

(10) Patent No.: US 9,291,161 B2
(45) Date of Patent: Mar. 22, 2016

(54) COMPACT LINEAR ACTUATOR

(71) Applicants: James Victor Hogan, Ladysmith, CA (US); Robert James Pletscher, Nanaimo, CA (US)

(72) Inventors: James Victor Hogan, Ladysmith, CA (US); Robert James Pletscher, Nanaimo, CA (US)

(73) Assignee: James Victor Hogan, Ladysmith, British Columbia (CA)

( * ) Notice: Subject to any disclaimer, the term of this patent is extended or adjusted under 35 U.S.C. 154(b) by 728 days.

(21) Appl. No.: 13/633,604

(22) Filed: Oct. 2, 2012

(65) Prior Publication Data

US 2014/0090552 A1 Apr. 3, 2014

(51) Int. Cl.

| | |
|---|---|
| ***F01L 25/02*** | (2006.01) |
| ***F04B 49/22*** | (2006.01) |
| ***F01L 25/06*** | (2006.01) |
| ***F15B 15/20*** | (2006.01) |

(52) U.S. Cl.

CPC ..... *F04B 49/22* (2013.01); *F01L 25/063* (2013.01); *F01L 25/066* (2013.01); *F15B 15/202* (2013.01)

(58) Field of Classification Search

CPC ..... F15B 15/202; F15B 15/225; F01L 25/06; F01L 25/063; F01L 25/066

USPC ..... 91/306, 311, 313

See application file for complete search history.

(56) References Cited

U.S. PATENT DOCUMENTS

| | | | | |
|---|---|---|---|---|
| 2,380,315 | A * | 7/1945 | Kilian | 91/7 |
| 3,780,622 | A | 12/1973 | Vogel et al. | |
| 3,846,048 | A | 11/1974 | Robbins et al. | |
| 3,922,116 | A | 11/1975 | Pugh | |
| 4,029,440 | A * | 6/1977 | Olsen | 91/305 |
| 4,345,880 | A | 8/1982 | Zanarini | |
| 4,368,008 | A | 1/1983 | Budzich | |
| 4,373,865 | A | 2/1983 | Budzich | |
| 4,397,614 | A | 8/1983 | Larner | |
| 4,653,986 | A | 3/1987 | Ashton | |
| 4,680,930 | A * | 7/1987 | Dollison | 91/311 |
| 4,761,118 | A | 8/1988 | Zanarini | |
| 4,784,579 | A | 11/1988 | Gazzera | |
| 4,899,638 | A | 2/1990 | Brown | |
| 5,238,372 | A | 8/1993 | Morris | |
| 5,275,540 | A | 1/1994 | Brown | |
| 5,651,389 | A * | 7/1997 | Anderson | 417/393 |
| 6,537,039 | B2 | 3/2003 | Mann | |
| 6,568,911 | B1 | 5/2003 | Brightwell et al. | |
| 2008/0122195 | A1 | 5/2008 | Beeson et al. | |
| 2009/0000872 | A1 | 1/2009 | Yokoyama | |
| 2009/0218327 | A1 | 9/2009 | Beeson | |
| 2010/0132351 | A1 | 6/2010 | Silvestro | |

* cited by examiner

*Primary Examiner* — Michael Leslie

(74) *Attorney, Agent, or Firm* — Todd A. Rattray; Oyen Wiggs Green & Mutala, LLP

(57) ABSTRACT

A fluid-driven linear actuator comprises a piston configured for reciprocating motion in a piston chamber and a spool valve in a valve chamber. The valve chamber is fluidly connected to a fluid input and to a fluid output. The spool valve is configured to be hydraulically moved within the valve chamber between a plurality of spool valve configurations, comprising a first spool valve configuration wherein the valve chamber is fluidly connected to the piston chamber to thereby create a first fluid pressure differential which tends to force the piston in a first axial direction and a second spool valve configuration wherein the valve chamber is fluidly connected to the piston chamber to thereby create a second fluid pressure differential which tends to force the piston in a second axial direction. The actuator also comprises at least one switch valve configured to be switched between a plurality of switch valve configurations and to thereby create one or more differential pressure configurations which hydraulically move the spool valve.

20 Claims, 15 Drawing Sheets

COMPACT LINEAR ACTUATOR

TECHNICAL FIELD

The invention relates to linear actuators. Particular embodiments provide linear actuators for use in compact hydraulic multi-stage linear air compressors.

BACKGROUND

Portable air compressors are commonly found in construction and trades industries. Many commercial air compressors are towed behind, or loaded onto, utility vehicles for use at job sites and are powered by an external source of fuel. These compressors may be large, heavy, suffer from performance issues and require independent power sources.

Linearly actuated air compressors may address some of these issues by facilitating dual stage compression, which can allow for smaller piston sizes and higher cycle speeds. Also, the power created by a linear actuator may be more directly transferred into compressed air than rotational actuator and may reduce or eliminate side loading on air pistons, seals and hydraulic pistons.

Prior art linear actuators include those disclosed in:

U.S. Pat. No. 4,899,638;
U.S. Pat. No. 4,784,579;
U.S. Pat. No. 4,761,118;
U.S. Pat. No. 3,780,622;
U.S. Pat. No. 5,238,372;
U.S. Pat. No. 3,846,048;
U.S. Pat. No. 5,275,540;
U.S. Pat. No. 4,397,614; and
U.S. Pat. No. 3,922,116.

There is a general desire to provide linear actuators and linear actuated air compressors that improve upon known prior art designs.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a fluid-driven linear actuator comprising: a piston configured for reciprocating motion in a bore defined by a piston chamber; a spool valve in a valve chamber, the valve chamber fluidly connected to a fluid input and to a fluid output, the spool valve configured to be hydraulically moved within the valve chamber between a plurality of spool valve configurations, the plurality of spool valve configurations comprising a first spool valve configuration wherein the valve chamber is fluidly connected to the piston chamber to thereby create a first fluid pressure differential which tends to force the piston in a first axial direction in the piston chamber and a second spool valve configuration wherein the valve chamber is fluidly connected to the piston chamber to thereby create a second fluid pressure differential which tends to force the piston in a second axial direction in the piston chamber; and at least one switch valve configured to be switchable between a plurality of switch valve configurations by the reciprocating motion of the piston and to thereby create one or more differential pressure configurations which hydraulically move the spool valve. The spool valve may be held in at least one of the plurality of spool valve configurations by fluid pressure.

Another aspect of the invention provides a fluid-driven linear actuator comprising: a piston configured for reciprocating motion in a bore defined by a piston chamber; a spool valve in a valve chamber, the valve chamber fluidly connected to a fluid input and to a fluid output, the spool valve configured to be hydraulically moved within the valve chamber between a plurality of spool valve configurations, the plurality of spool valve configurations comprising a first spool valve configuration wherein the valve chamber is fluidly connected to the piston chamber to thereby create a first fluid pressure differential which tends to force the piston in a first axial direction in the piston chamber and a second spool valve configuration wherein the valve chamber is fluidly connected to the piston chamber to thereby create a second fluid pressure differential which tends to force the piston in a second axial direction in the piston chamber; and at least one switch valve configured to be switchable between a plurality of switch valve configurations by the reciprocating motion of the piston and to thereby create one or more differential pressure configurations which hydraulically move the spool valve. The at least one switch valve may comprise an intersection of a fluid conduit channel with a piston rod, the piston rod coupled to the piston or integrally formed with the piston for axial movement therewith.

The piston rod may comprise a recessed groove at an axial location thereon. The at least one switch valve may be switchable between a first one of the plurality of switch valve configurations when the groove is axially aligned with the fluid conduit channel and a second one of the plurality of switch valve configurations when the groove is out of axial alignment with the fluid conduit channel.

The piston rod may comprise a switching feature at an axial location thereon. The plurality of switch valve configurations may comprise a first switch valve configuration when the switching feature is axially aligned with the fluid conduit channel. The first switch valve configuration may permit fluid flow through a first fluid pathway and may thereby create a corresponding first differential pressure configuration which hydraulically moves the spool valve toward the first spool valve configuration. The plurality of switch valve configurations may comprise a second switch valve configuration when the switching feature is out of axial alignment with the fluid conduit channel. The second switch valve configuration may block fluid flow through the first fluid pathway and may permit fluid flow into the piston chamber on a first axial side of the piston and out of the piston chamber from a second axial side of the piston, and may thereby create a corresponding second differential pressure configuration which exerts fluid pressure which tends to hold the spool valve in the first spool valve configuration.

Another aspect of the invention provides a method for creating reciprocating motion in a fluid-driven linear actuator. The method comprises: providing a continuous flow of fluid to a valve chamber; directing the fluid to a first side of a piston in a piston chamber until the piston reaches a first end of a piston stroke; at the first end of the piston stroke, switching a first switch valve from a first switch valve configuration to a second switch valve configuration, thereby directing the fluid to hydraulically move a spool valve within the valve chamber from a first spool valve configuration to a second spool valve configuration; wherein shifting the first spool valve to the second spool valve configuration prevents fluid flow to the first side of the piston and directs the fluid to a second side of the piston until the piston reaches a second end of the piston stroke.

The method may comprise: at the second end of the piston stroke, shifting a second switch valve from a third spool valve configuration to a fourth spool valve configuration thereby directing the fluid to hydraulically move the spool valve within the valve chamber from the second spool valve configuration to the first spool valve configuration; wherein shifting the spool valve to the first spool valve configuration directs the fluid to the first side of the piston and prevents fluid flow to the second side of the piston.

Switching the first switch valve from the first switch valve configuration to the second switch valve configuration may comprise mechanically shifting the first switch valve. Switching the first switch valve from the first switch valve configuration to the second switch valve configuration may comprise selectively connecting a fluid pathway passing through the piston chamber. Switching the first switch valve from the first switch valve configuration to the second switch valve configuration may comprise aligning a switching feature on a piston rod with a fluid conduit channel.

Another aspect of the invention provides a fluid-driven linear actuator comprising: a piston configured for reciprocating motion in a piston chamber; a spool valve positioned for reciprocating motion in a valve chamber; a fluid input in fluid connection with the valve chamber for providing pressurized fluid to the valve chamber; a fluid output in fluid connection with the valve chamber for releasing fluid from the linear actuator; the piston chamber comprising a first and second stroke port and a first and second switch port each fluidly connectable with the valve chamber; wherein the spool valve has a plurality of configurations comprising: a first spool valve configuration fluidly connecting the fluid input to the first stroke port and fluidly connecting the fluid output to the second stroke port; a second spool valve configuration fluidly connecting the fluid input to the second stroke port and fluidly connecting the fluid output to the first stroke port; a third spool valve configuration fluidly connecting the fluid input and the fluid output to the first switch port; and a fourth spool valve configuration fluidly connecting the fluid input and the fluid output to the second switch port; and a pair of switch valves each configured to connect and disconnect one of the first and second switch ports to the fluid outlet; wherein the spool valve is moved between the first, second, third and fourth spool valve configurations by changes in fluid pressure.

The switch valves may be mechanically switched between configurations by the piston.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Figure 1A:
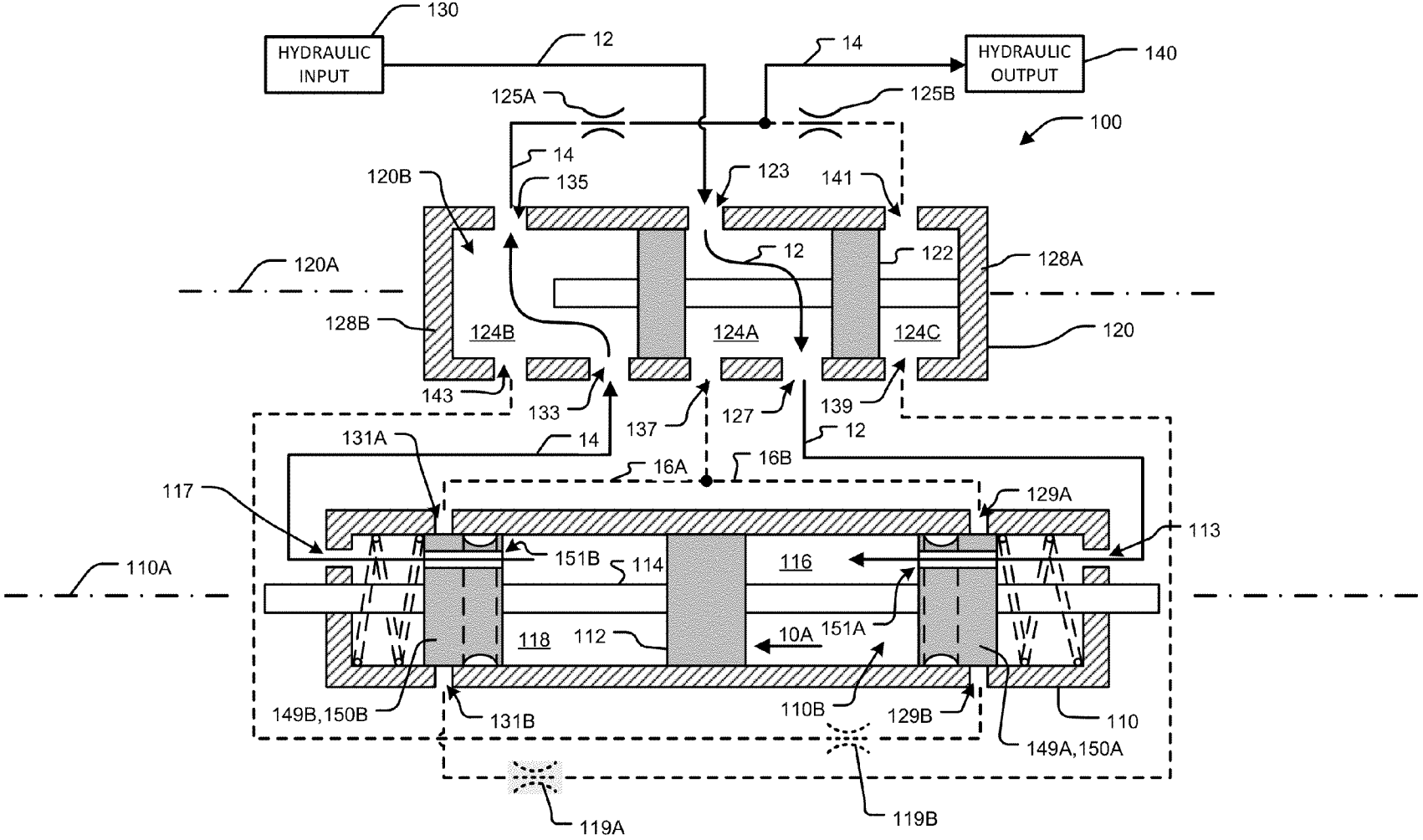
FIGS. 1A-1D show schematic views of various stages of a stroke cycle of a linear actuator according to an embodiment of the invention.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

FIGS. 1A-1D show schematic views of various stages of a stroke cycle of a linear actuator 100 according to an embodiment of the invention. Linear actuator 100 comprises a piston chamber 110 in fluid communication with a valve chamber 120. Piston chamber 110 and valve chamber 120 may define bores or cavities, which may be elongated and cylindrical (e.g. circular in cross-section) or elongated with some other appropriate cross-sectional shape. In the illustrated embodiment, piston chamber 110 and valve chamber 120 are respectively elongated along piston axis 110A and valve axis 120A to define correspondingly elongated bores 110B, 120B. In the illustrated embodiment, piston axis 110A and valve axis 120A are offset from (i.e. non-co-axial with) one another. While piston axis 110A and valve axis 120A of the illustrated embodiment are non-coaxial, they are parallel. This is not necessary in general and in some embodiments, piston axis 110A may be provided at some orthogonal or oblique angle relative to valve axis 120A.

Piston chamber bore 110B contains a piston 112 disposed on an axially extending piston rod 114. Piston 112 may have a cross-sectional shape which complements piston chamber bore 110B. Piston rod 114 has a cross-sectional dimension (or area) that is less than that of piston 112 and may have any suitable cross-sectional shape. Piston 112 is configured for reciprocating motion within piston chamber bore 110B which may be hermetically sealed, hydraulically sealed, or the like, such that a differential pressure on one side of the piston 112 displaces piston 112 axially within piston chamber 110. In the embodiment of FIGS. 1A-1D, piston chamber bore 110B also houses first and second switch valves 150A, 150B which may have cross-sectional shapes that complement the interior cavity of piston chamber bore 110B. Switch valves 150A, 150B may be selectively configured (e.g. by movement (axial or otherwise) of corresponding moveable switching components 149A, 149B) to control the flow of hydraulic fluid through piston chamber 110. Valve chamber bore 120B contains a spool valve 122 configured to move axially (e.g. to shift) between a plurality of configurations (e.g. positions) within valve chamber bore 120B. Spool valve 122 may have a cross-sectional shape that complements valve chamber bore 120B. As explained in more detail below, spool valve 122 and switch valves 150A, 150B selectively connect hydraulic input 130 to various input ports of piston chamber 110 and selectively connect hydraulic output 140 to various output ports of piston chamber 110. These selective connections effected by spool valve 122 and switch valves 150A, 150B cause piston 112 to reciprocate in piston chamber 110.

FIG. 1A shows piston 112 at an arbitrary starting configuration in the middle of a stroke, where piston 112 is travelling in direction 10A (leftward in the illustrated view). Linear actuator 100 comprises a hydraulic linear actuator, where hydraulic input 130 provides a hydraulic fluid to valve chamber 120 and piston chamber 110. In the initial configuration of FIG. 1A, spool valve 122 connects hydraulic input 130 to a first piston chamber port 113, such that hydraulic input 130 is fluidly connected to piston chamber 110 along a fluid pathway 12. Fluid pathways in the drawings are either depicted in solid lines, indicating substantial fluid flow, or dotted lines, indicating a lack of substantial fluid flow. Fluid pathway 12 conveys hydraulic fluid from input 130, into valve chamber 120 via spool valve input port 123, through cavity portion 124A of valve chamber bore 120B, exiting valve chamber 120 through port 127 and into piston chamber 110 through port 113. Once the fluid enters piston chamber 110 through port 113, the fluid passes through conduit 151A of first switch valve 150A and into cavity portion 116 of piston chamber bore 110B. As will become more apparent with the discussion that follows, in the initial stage of the reciprocating cycle shown in FIG. 1A, first switch valve 150A and second switch valve 150B are in closed configurations, blocking flow in fluid pathways 16 (shown in FIG. 1A by broken lines) between valve chamber 120 and piston chamber 110.

The flow of fluid along fluid pathway 12 into cavity portion 116 creates pressure in cavity portion 116 which drives piston 112 in direction 10A. The motion of piston 112 in direction 10A causes fluid to flow along a fluid pathway indicated by arrows 14. More particularly, hydraulic fluid flows out of cavity portion 118 of piston chamber bore 110B, through conduit 151B of second switch valve 150B, out of piston chamber 110 via port 117, into cavity portion 124B of valve chamber port 120B via port 133, exiting valve chamber 120 through port 135 and then to output 140. The fluid flow in pathway 14 creates a dynamic pressure in cavity portion 124B which tends to hold spool valve 122 in the illustrated position against first end wall 128A of valve chamber 120. In the illustrated embodiment, fluid pathway 14 includes an optional first flow restriction 125A between port 135 of valve chamber 120 and output 140. Restriction 125A helps to create a back pressure and a corresponding pressure differential between the relatively high dynamic pressure in cavity portion 124B of valve chamber bore 120B and the relatively low static pressure in a cavity portion 124C of valve chamber bore 120B. This pressure differential maintains spool valve 122 in the FIG. 1A configuration (e.g. against first end wall 128A) to drive piston 112 in direction 10A until the end of the stroke of linear actuator 100.

In some embodiments, spool valve ports may be provided with different sizes (in addition to or in the alternative to restriction 125A) to help increase the pressure in cavity portion 124B relative to cavity portion 124C. For example, in some embodiments, spool valve exit port 135 may be smaller than spool valve supply port 133 which can help to build pressure in cavity portion 124B of valve chamber bore 120B.

Figure 1B:
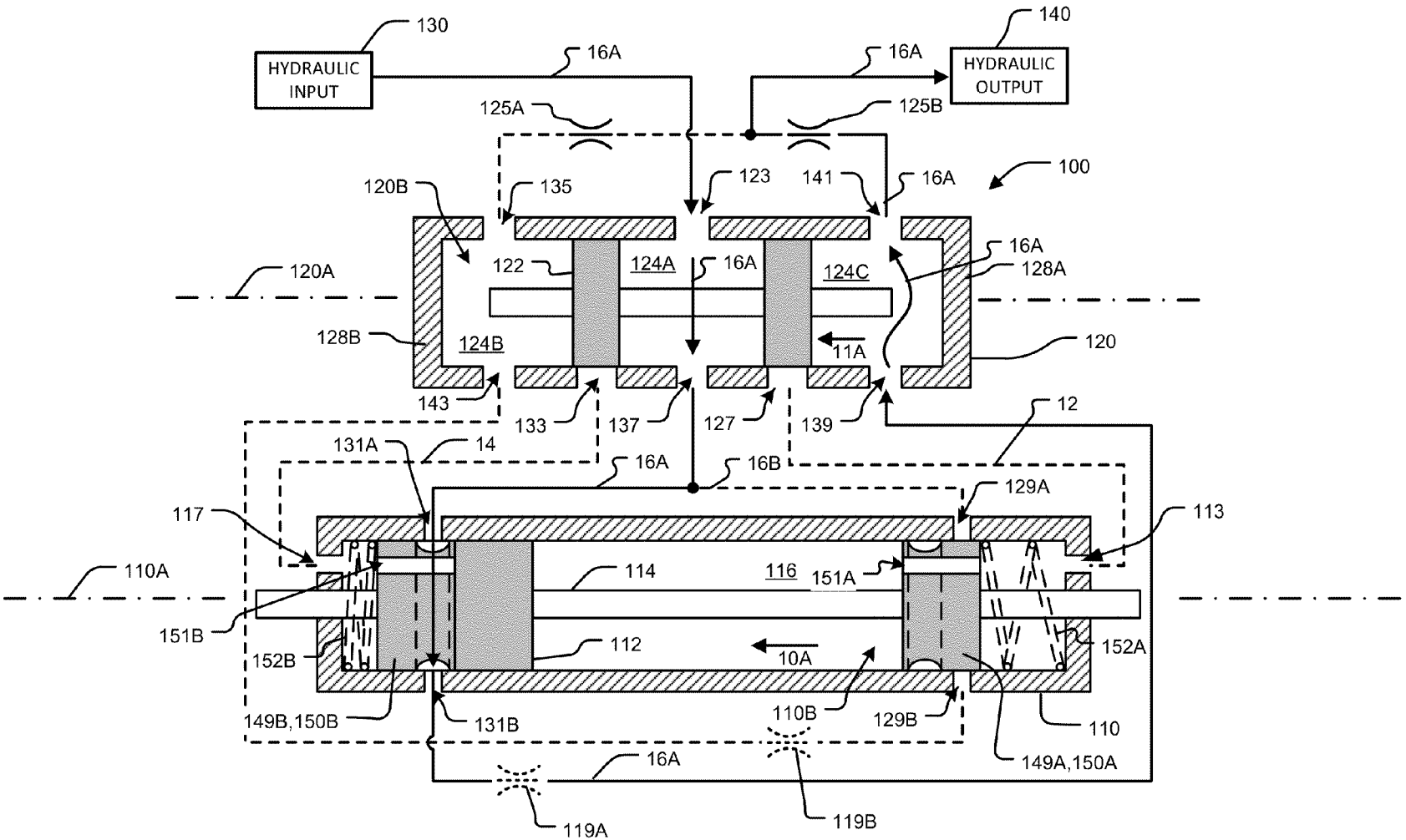

FIG. 1B shows linear actuator 100 as piston 112 moves in direction 10A toward the end of its piston stroke. When linear actuator 100 approaches the end of its stroke, piston 112 contacts second switch valve 150B and switches second switch valve 150B from its closed configuration (FIG. 1A) to an open configuration (FIG. 1B) which permits fluid flow between ports 131A, 131B of piston chamber 110. In the illustrated embodiment, piston 112 contacts a second moveable switching component 149B of second switch valve 150B and moves second moveable switching component 149B axially along piston axis 110A, thereby mechanically switching second switch valve 150B. Piston 112 may apply pressure to a face of second moveable switching component 149B which compresses a bias mechanism 152B (e.g. a spring or the like).

As second switch valve 150B reaches the open configuration (e.g. second moveable switching component 149B reaches its open position), a "short circuit" fluid pathway 16A is opened between hydraulic input 130 and hydraulic output 140. In fluid pathway 16A, fluid flows from hydraulic input 130, into cavity portion 124A of valve chamber 120 via port 123, exiting valve chamber 120 via port 137, short circuiting through piston chamber 110 via ports 131A, 131B, returning to valve chamber 120 and into cavity portion 124C via port 139, exiting valve chamber 120 via portion 141 and returning to fluid output 140. In the illustrated embodiment, fluid pathway 16A passes through piston chamber 110 (via ports 131A, 131B), but this is not necessary. In some embodiments, fluid may be caused to bypass piston chamber 110 altogether. In the illustrated embodiment, moveable switching component 149B comprises a concavity in at least a portion of its perimeter (e.g. circumferential) surface (e.g. an annular concavity or a semi-annular concavity) such that when switch valve 150B is in its open configuration (FIG. 1B), fluid flows through port 131A, around at least a portion of the perimeter of moveable switching component 149B in the concavity and through port 131B. In the illustrated embodiment, the direction of such flow is orthogonal to piston axis 110A, but this is not necessary and such flow may be at an oblique angle with respect to piston axis 110A. In some embodiments, switch valve 150B may be otherwise shaped or configured to allow fluid flow through ports 131A, 131B.

With fluid pathway 16A open, the fluid flow causes a dynamic pressure in cavity portion 124C of valve chamber bore 120B which is relatively high in comparison to the static pressure in cavity portion 124B and which causes spool valve 122 to travel in direction 11A within valve chamber bore 120B, thereby hydraulically shifting spool valve 122 in an axial direction 11A to a new configuration (e.g. position) within valve chamber bore 120B. In the illustrated embodiment, fluid pathway 16A includes an optional second flow restriction 125B between port 141 and output 140, which may help to increase the pressure in cavity portion 124C. As is the case with cavity portion 124B discussed above, in some embodiments, spool valve ports of different sizes may additionally or alternatively be provided to help increase the pressure in cavity portion 124C. For example, in some embodiments, spool valve exit port 141 may be smaller than spool valve supply port 139 which can help to build pressure in cavity portion 124C of valve chamber bore 120B relative to cavity portion 124B. The dynamic pressure in cavity portion 124C of valve chamber bore 120B increases relative to the now static pressure in cavity portion 124B of valve chamber bore 120B. The static pressure in cavity portion 124B results from the cessation of fluid flow along fluid pathway 14 because piston 112 is no longer forcing fluid out of piston chamber 110 through port 117.

In addition to switch valve 150B opening fluid pathway 16A, as spool valve 122 moves (e.g. axially shifts) in direction 11A in valve chamber 120 (FIG. 1B), spool valve 122 closes port 127, thereby closing fluid pathway 12 and disconnecting port 113 of piston chamber 110 from hydraulic input 130. As fluid pathway 12 is closed, flow of fluid from valve chamber 124A to cavity portion 116 of piston chamber bore 110B decreases toward zero. At the same time, the flow of fluid along fluid pathway 16A is increasing as explained above. Consequently, near the end of the piston stroke, the flow in fluid pathway 12 decreases, while the flow in fluid pathway 16A increases, thereby maintaining non-zero fluid flow through actuator 100 throughout the stroke cycle, minimizing flow blockages and associated pressure spikes.

Figure 1C:
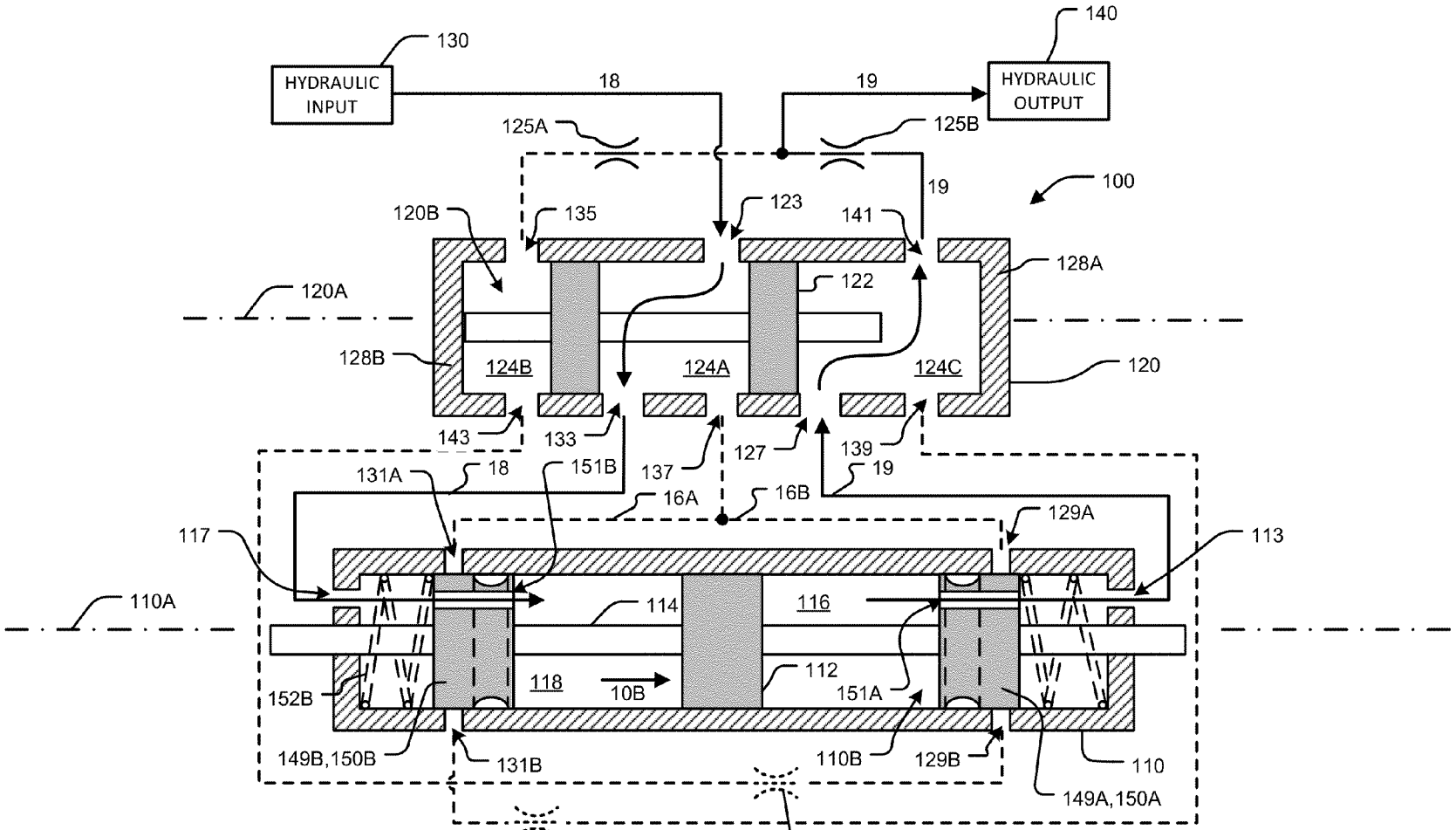

Spool valve 122 continues to travel in direction 11A until it reaches the configuration shown in FIG. 1C, where (in the illustrated view) spool valve 122 has reached its leftmost position in valve chamber 120 (e.g. in contact with second end wall 128B). In this configuration, spool valve 122 fluidly connects input 130 to cavity portion 118 of piston chamber bore 110B by way of a fluid pathway indicated by arrows 18. Fluid pathway 16A may be provided with one or more optional restrictions 119A at one or more corresponding locations between spool valve output port 137 and spool valve input port 139 for building pressure which may encourage fluid flow in fluid pathway 18 when spool valve 122 has reached the FIG. 1C configuration, but piston 112 has initially not yet moved from its FIG. 1B configuration. In the illustrated embodiment, restriction 119A is shown between ports 131B and 139, but this is not necessary. In some embodiments, restriction 119A may be at one or more other locations on fluid pathway 16A between spool valve output port 137 and spool valve input port 139. In some embodiments, restriction 119A may be provided by any one or more of ports 131A, 131B, 139 and/or by the path through switch valve 150B (i.e. between ports 131A, 131B).

Once spool valve 122 and piston 112 are in the configuration of FIG. 1C, fluid flows along fluid pathway 18 from input 130 into cavity portion 124A of valve chamber 120 via port 123, exiting valve chamber 120 through port 133, into piston chamber 110 through port 117, through conduit 151B of second switch valve 150B and into cavity portion 118 of piston chamber bore 110B. Similarly to the configuration of FIG. 1A but in the opposite direction 10B, fluid entering cavity portion 118 of piston chamber bore 110B forces piston 112 to travel in direction 10B by exerting pressure on piston 112. As piston 112 moves in direction 10B, second switch valve 150B is returned to its original position by bias mechanism 152B. Suitable stop(s) (not shown) may be provided to limit the axial travel of switch valve 150B under the influence of bias mechanism 152B. Also, fluid from cavity portion 116 of piston chamber bore 110B is returned to output 140 via a fluid pathway 19. Fluid in fluid pathway 19 is pushed out of cavity portion 116 of piston chamber 110 through conduit 151A of first switch valve 150A, exiting piston chamber 110 via port 113, entering cavity portion 124C of valve chamber 120 via port 127, exiting valve chamber 120 via port 141 and returning to hydraulic output 140.

The flow through cavity portion 124C of valve chamber 120 creates a dynamic pressure in cavity portion 124C which is relatively high in comparison to the static pressure in cavity portion 124B and which helps to maintain spool valve 122 in the illustrated configuration of FIG. 1C. Also, in the case of the illustrated embodiment, the flow of fluid to outlet 140 through optional flow restriction 125B can help to increase the pressure in cavity portion 124C relative to cavity portion 124B. Additionally or alternatively, valve exit port 141 may be made relatively small in comparison to supply port 127, thereby helping to increase the pressure in cavity portion 124C. This pressure differential between cavity portion 124C and cavity portion 124B holds spool valve 122 in the FIG. 1C configuration. In this phase of the stroke cycle, piston 112 continues to travel in direction 10B until piston 112 contacts first switch valve 150A.

Figure 1D:
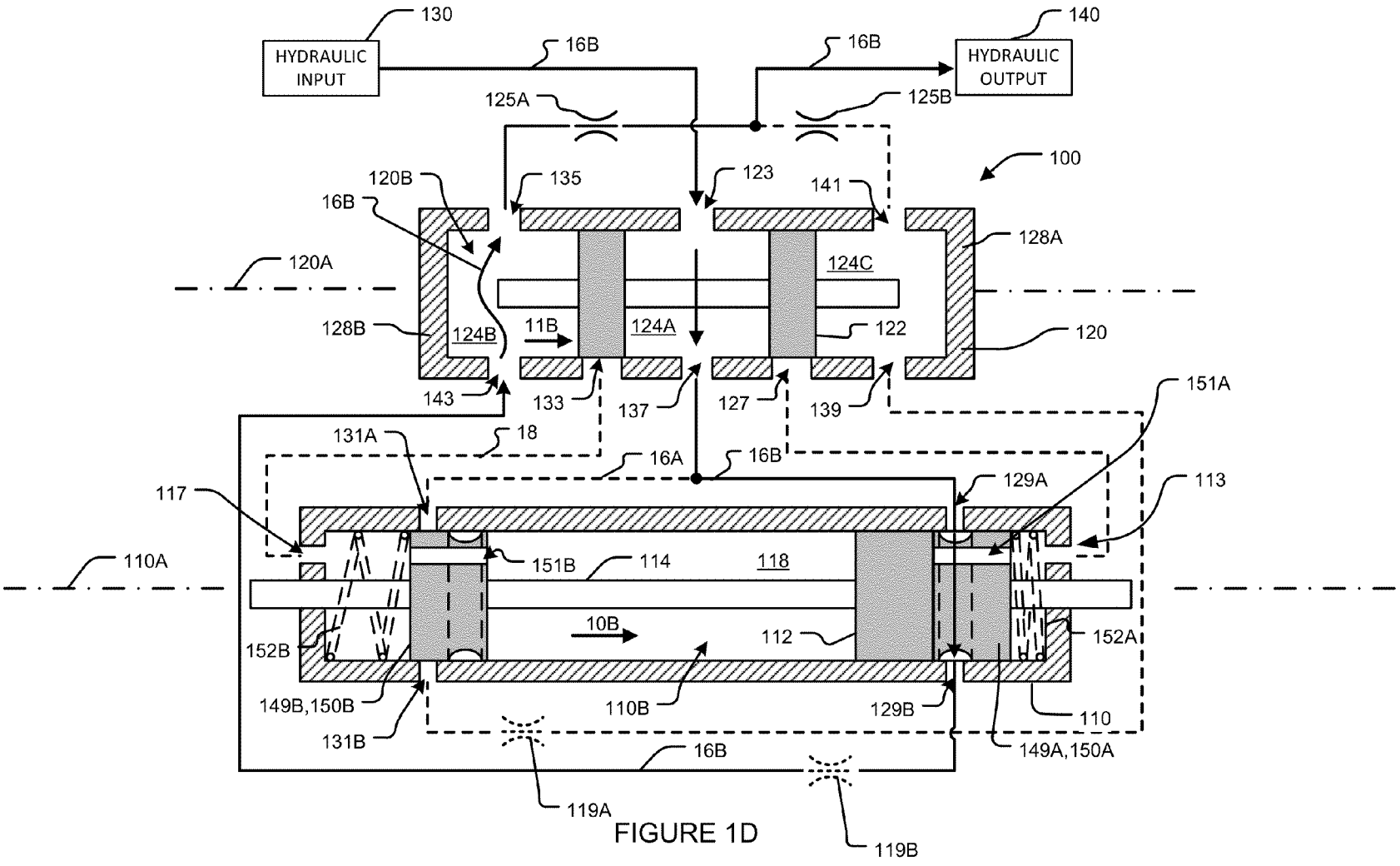

FIG. 1D shows linear actuator 100 as piston 112 moves in direction 10B toward the end of its piston stroke. When linear actuator 100 approaches the end of its stroke, piston 112 contacts first switch valve 150A and switches first switch valve 150A from its closed configuration (FIG. 1C) to an open configuration (FIG. 1D) which permits fluid flow between ports 129A, 129B of piston chamber 110. In the illustrated embodiment, piston 112 contacts a first moveable switching component 149A of first switch valve 150A and moves first moveable switching component 149A axially along piston axis 110A, thereby mechanically switching first switch valve 150A. Piston 112 may apply pressure to a face of first moveable switching component 149A which compresses a bias mechanism 152A (e.g. a spring or the like).

As first switch valve 150A reaches the open configuration (e.g. first moveable switching component 149A reaches its open position), a "short circuit" fluid pathway 16B is opened between hydraulic input 130 and hydraulic output 140. In fluid pathway 16B, fluid flows from hydraulic input 130, into cavity portion 124A of valve chamber 120 via port 123, exiting valve chamber 120 via port 137, short circuiting through piston chamber 110 via ports 129A, 129B, returning to valve chamber 120 and into cavity portion 124B via port 143, exiting valve chamber 120 via port 135 and returning to fluid output 140. In the illustrated embodiment, as is the case with fluid pathway 16A, fluid pathway 16B passes through piston chamber 110 (via portions 129A, 129B), but this is not necessary. In other embodiments, fluid may be caused to bypass piston chamber 110 altogether. In the illustrated embodiment, moveable switching component 149A comprises a concavity over at least a portion of its perimeter (e.g. circumferential) surface (e.g. an annular concavity or semi annular concavity) such that when switch valve 150A is in its open configuration (FIG. 1D), fluid flows through port 129A, around at least a portion of perimeter of moveable switching component 149A in the concavity and through port 129B. In the illustrated embodiment, the direction of such flow is orthogonal to piston axis 110A, but this is not necessary and such flow may be at an oblique angle with respect to piston axis 110A. In some embodiments, switch valve 150A may be otherwise shaped or configured to allow fluid flow through ports 129A, 129B.

With fluid pathway 16B open, the fluid flow causes a dynamic pressure in cavity portion 124B of valve chamber bore 120B which is relatively high compared to the static pressure in cavity portion 124C and which causes spool valve 122 to travel in direction 11B within valve chamber bore 120B, thereby hydraulically moving (e.g. axially shifting) the configuration (e.g. position) of spool valve 122. In the illustrated embodiment, fluid pathway 16B includes optional first flow restriction 125A between port 135 and output 140, which helps to create back pressure in cavity portion 124B. Additionally or alternatively, valve chamber exit port 135 may be made smaller than valve chamber supply port 143 to assist with the build-up of back pressure in cavity portion 124B. This dynamic pressure increases the pressure in cavity portion 124B of valve chamber bore 120B relative to the now static pressure in cavity portion 124C of valve chamber bore 120B. The static pressure in cavity portion 124C results from the cessation of fluid flow along fluid pathway 19 because piston 112 is no longer forcing fluid out of piston chamber 110 through port 113.

In addition to switch valve 150A opening fluid pathway 16B, as spool valve 122 moves (e.g. axially shifts) in direction 11B in valve chamber 120 (FIG. 1D), spool valve 122 closes port 133, thereby closing fluid pathway 18 and disconnecting port 117 of piston chamber 110 from hydraulic input 130. As fluid pathway 18 is closed, flow of fluid from valve chamber 124A to cavity portion 118 of piston chamber bore 110B decreases toward zero. At the same time, the flow of fluid along fluid pathway 16B is increasing as explained above. Consequently, near the end of the piston stroke, the flow in fluid pathway 18 decreases, while the flow in fluid pathway 16B increases, thereby maintaining non-zero fluid flow through actuator 100 throughout the stroke cycle, minimizing flow blockages and associated pressure spikes.

Spool valve 122 continues to travel in direction 11B until it reaches the configuration shown in FIG. 1A, where (in the illustrated view) spool valve 122 has reached its rightmost position in valve chamber 120 (e.g. in contact with first end wall 128A). In this configuration, spool valve 122 fluidly connects input 130 to cavity portion 116 of piston chamber bore 110B by way of fluid pathway 12 as discussed above. Fluid pathway 16B may be provided with one or more optional restrictions 119B at one or more corresponding locations between spool valve output port 137 and spool valve input port 143 for building pressure which may encourage fluid flow in fluid pathway 12 when spool valve 122 has reached the FIG. 1A configuration, but piston 112 has initially not yet moved from its FIG. 1D configuration. In the illustrated embodiment, restriction 119B is shown between ports 129B and 143, but this is not necessary. In some embodiments, restriction 119B may be at one or more other locations on fluid pathway 16B between spool valve output port 137 and spool valve input port 143. In some embodiments, restriction 119B may be provided by any one or more of ports 129A, 129B, 143 and/or by the path through switch valve 150A (i.e. between ports 129A, 129B).

The stroke cycle shown in FIGS. 1A-1D repeats automatically as long as fluid flows continuously from inlet 130. As the stroke cycle transitions back to the configuration shown in FIG. 1A, bias mechanism 152A provides a restorative force to return switch valve 150A to its original position. Suitable stop(s) (not shown) may be provided to limit the axial travel of switch valve 150A under the influence of bias mechanism 152A. The continuous and gradual transition of the switch valves 150A, 150B from their open (or switched) configurations to their closed configurations may allow the geometry of piston 112 to be independent of its stroke length. For example, the axial dimension of piston 112 (e.g. along piston chamber axis 110A) may be less than the axial distance between switch valve ports 129A, 129B and switch valve ports 131A, 131B in piston chamber 110. As another example, the axial dimension of piston 112 (e.g. along piston chamber axis 110A) may be less than the axial distance of travel of piston 112 during the reciprocating piston stroke. The independence of the piston geometry from the stroke length of linear actuator 100 may allow for short piston lengths and correspondingly more compact linear actuators relative to known linear actuators. Also, coupling the selective opening of switch valves 150A, 150B to the piston motion combined with a non-coaxial valve chamber 120 and piston chamber 110 allows for spool valve 122 to be hydraulically or fluidly moved (e.g. axially shifted) between its various configurations, thereby simplifying the design of the linear actuator.

The embodiment shown in FIGS. 1A-1D is an example configuration and other physical linear actuator designs are contemplated.

Figure 2A:
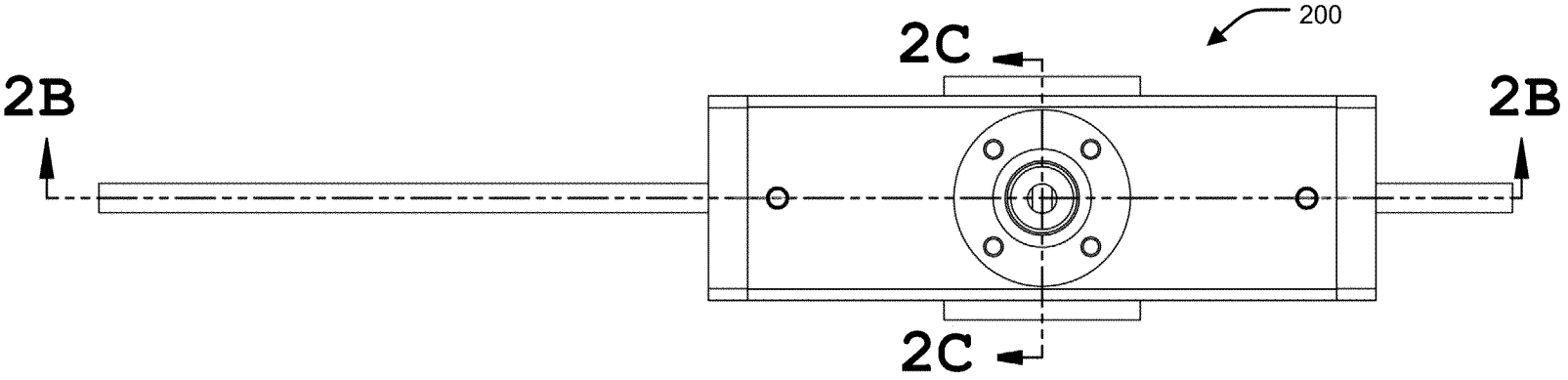
FIG. 2A shows a top view of a linear actuator according to an embodiment of the invention.
Figure 2B:
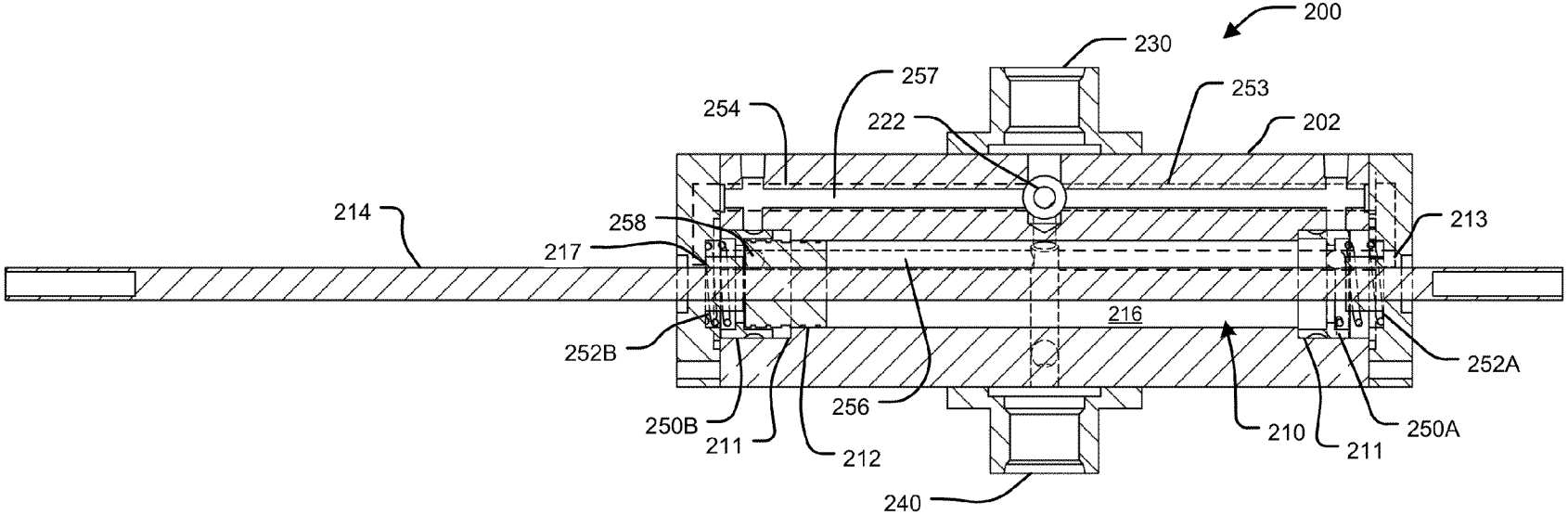
FIG. 2B shows a front cross-section view along lines 2B-2B of FIG. 2A.
Figure 2C:
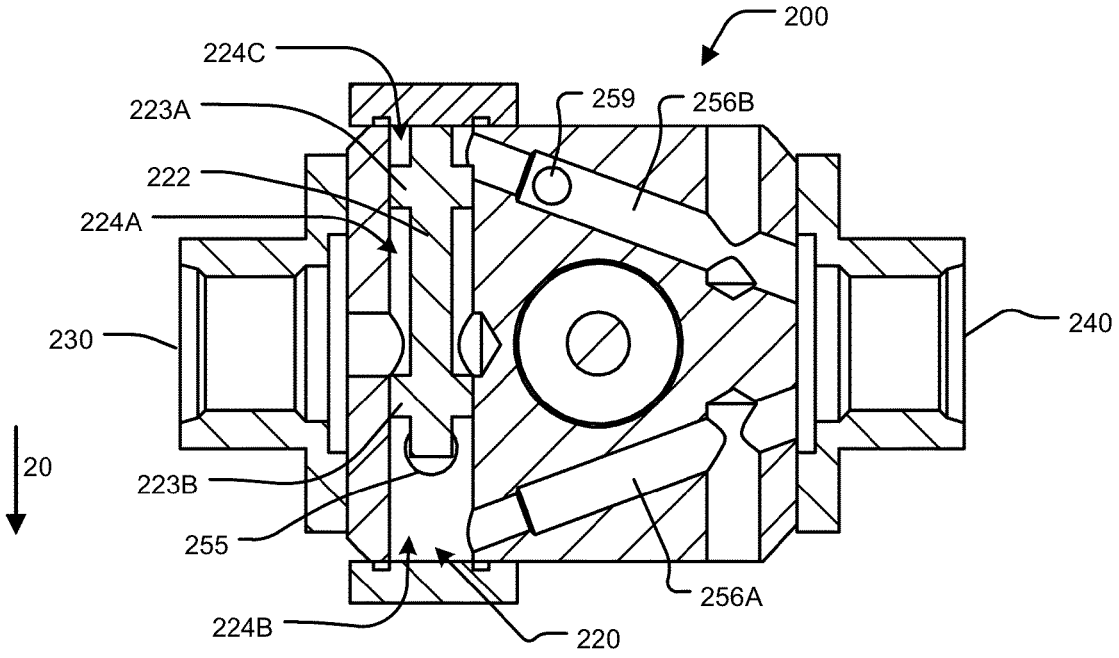
FIG. 2C shows a side cross-section view along lines 2C-2C of FIG. 2A.

FIGS. 2A-2C show another embodiment of a linear actuator 200 according to the invention. FIG. 2A shows a top plan view of linear actuator 200 in isolation. Linear actuator 200 may, for example, be a part of a hydraulic multi-stage linear air compressor.

FIG. 2B is a cross-sectional side elevation view of linear actuator 200 along section lines 2B-2B and FIG. 2C is a cross-sectional side elevation view of linear actuator 200 along section lines 2C-2C. Linear actuator 200 comprises a casing 202 in which a piston chamber bore 210 is fluidly connected to a valve chamber bore 220. Piston chamber bore 210 contains a piston 212 disposed on a piston rod 214. Piston 212 has a cross-sectional shape that is complementary to that of piston chamber bore 210 to prevent fluid (e.g. liquid) transfer between the cavity portions on either side of piston 212, such that differential pressure displaces piston 212 within the piston chamber bore 210, thereby driving piston 212 in a reciprocating manner.

Valve chamber bore 220 contains a spool valve 222 (seen best in FIG. 2C) configured to move between a plurality of positions within valve chamber bore 220. Spool valve 222 selectively connects a fluid input 230 to various input ports of piston chamber bore 210 and selectively connects a fluid output 240 to various output ports of piston chamber bore 210. In the illustrated embodiment, spool valve 222 comprises a first land 223A and a second land 223B, which define first 224A, second 224B and third 224C cavity portions within valve chamber bore 220.

Returning to FIG. 2B, linear actuator 200 also comprises a first switch valve 250A and a second switch valve 250B configured to be mechanically switched between configurations by piston 212 to connect or disconnect fluid pathways and fluidly (e.g. hydraulically) shift spool valve 222 between configurations. In the illustrated embodiment, switch valves 250A, 250B comprises concavities over at least a portion of their circumferential surfaces (e.g. annular concavities or semi-annular concavities) such that when switch valves 250A, 250B are in their open configurations, fluid flows through circumferentially around at least a portion of the body of switch valves 250A, 250B in the concavity. This is not necessary. In some embodiments, switch valves 250A, 250B may be otherwise shape or configured to allow fluid flow through in their open configuration. Switch valves 250A, 250B are respectively coupled to bias mechanisms 252A, 252B (e.g. suitable springs or the like). Bias mechanisms 252A, 252B act to return switch valves 250A, 250B to their original configurations after being actuated (e.g. by piston 212). In the FIG. 2 embodiment, switch valves 250A, 250B are located within recesses 211 defined in casing 202. Recesses 211 provide suitable stops to prevent bias mechanisms 252 from forcing switch valves 250A, 250B further than intended into piston chamber bore 210.

In the illustrated view of FIG. 2B, piston 212 is shown near the end of a stroke. Piston 212 is forced into this position by pressure facilitated by fluid flow from input 230, through a first flow channel 253 and a first piston chamber port 213, passing through first switch valve 250A into cavity portion 216 of piston chamber bore 210. As piston 212 is forced into the illustrated position, fluid is forced out of piston chamber bore 210 through second piston chamber port 217 and a second flow channel 254 to cavity portion 224B of valve chamber bore 220 via return port 255, then to outlet 240 via exit channel 256A. This fluid pathway maintains spool valve 222 in the position illustrated in FIG. 2C piston 212 is still moving and pushing fluid through port 217.

Also, with reference to both FIGS. 2B and 2C, in the illustrated position piston 212 has switched switch valve 250B to its switched/open configuration. As discussed in more detail below, in this embodiment, piston 212 has entered into switch valve 250B, engaging an inner ring 251 (see FIGS. 3A and 3B) of switch valve 250B and mechanically switching shift valve 250B to an open configuration from its original, closed configuration. With switch valve 250B in this open configuration, a fluid path is connected comprising input 230, first valve chamber cavity 224A, a first switch channel 257 (see FIG. 2B), switch valve 250B, hydraulic passage 258 (which extends into the page in the FIG. 2B view), return channel 259, exit channel 256B and outlet 240. The illustrated stage of linear actuator 200 corresponds to the stage between those depicted in FIGS. 1A and 1B of linear actuator 100. In this configuration, a dynamic pressure is created in cavity portion 224C (see FIG. 2C) of valve chamber bore 220, causing spool valve 222 to begin to move in direction 20.

As shown in FIGS. 2A-2C, the fluid channels are integrated into the structure of linear actuator 200, and piston chamber bore 210 and valve chamber bore 220 are axially skewed from (or otherwise non-parallel to) one another. The physical layout and design of the channels and chambers reduces the overall size of the device and increases design simplicity for ease of manufacture, reduced component counts and lower cost.

Figure 3A:
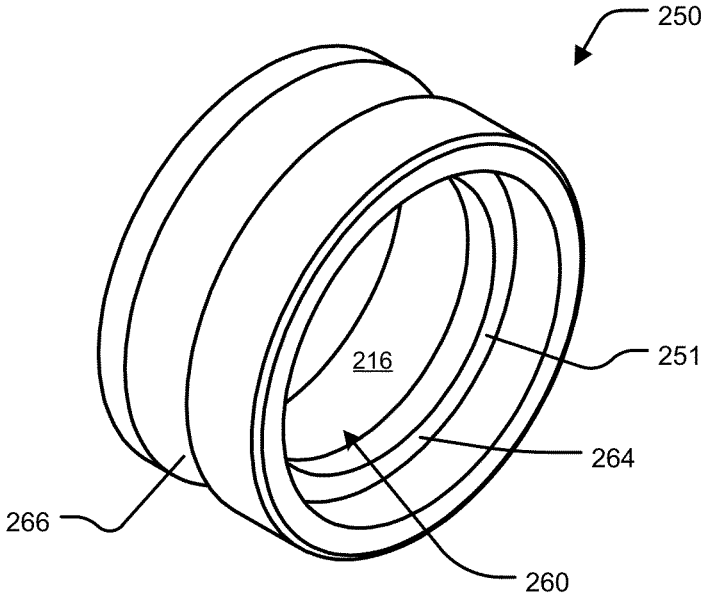
FIG. 3A shows a perspective view of a switch valve member according to an embodiment of the invention.
Figure 3B:
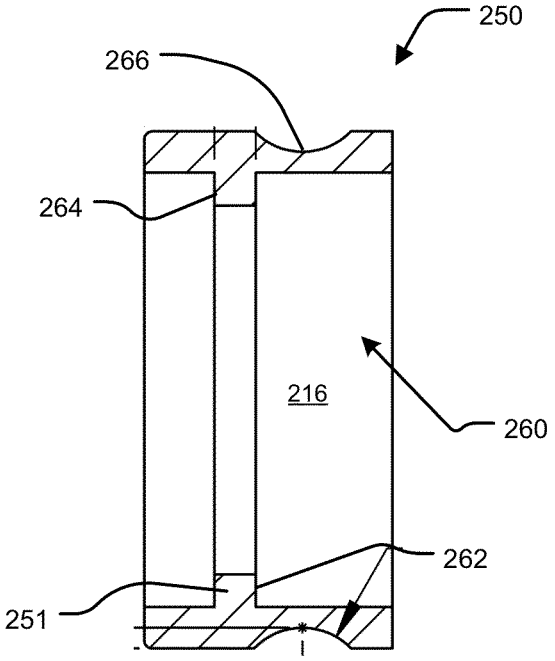
FIG. 3B shows a side cross-section view of the FIG. 3A switch valve member.

FIGS. 3A and 3B respectively show perspective and cross-sectional views of an example embodiment of a switch valve 250 in isolation. Switch valve 250 is suitable for use with linear actuator 200 shown in FIGS. 2A-2C. As mentioned above, switch valve 250 comprises an inner ring 251 which extending into a concavity 260 in the interior 216 of switch valve 250. Hollow space 260 allows fluid to enter piston chamber bore 210 and fill or drain the cavity portions on either side of piston 212. In this embodiment, inner ring 251 comprises a piston contact surface (or seat) 262 and a spring contact surface (or seat) 264. Piston contact surface 262 receives piston 212 as it reaches the appropriate end of a stroke, allowing piston 212 to effectively switch the position of switch valve 250. Spring contact surface 264 receives a spring 252 throughout the cycle of piston 212 and provides the necessary surface to allow spring 252 to apply a restorative force to switch valve 250 to maintain switch valve 250 in its closed configuration after piston 212 has disengaged from piston contact surface 262 (and switch valve 250).

Switch valve 250 also comprises an annular groove or concavity 266 around the outer (circumferential) surface of switch valve 250. In the illustrated embodiment, annular concavity 266 is located on the piston side of inner ring 251 but may be located elsewhere. Annular concavity 266 provides a fluid pathway around a circumference (or at least a portion of the circumference) of switch valve 250 when switch valve 250 is switched into its open configuration. This fluid pathway allows switch valve 250 to provide a short circuit between cavity portions 224 of valve chamber bore 220, allowing spool valve 222 to be fluidly (e.g. hydraulically) moved (e.g. axially shifted) as described above. In some embodiments, it is not necessary that concavity 266 be fully annular—e.g. in some embodiments, concavity 266 may be provided with a semi-annular shape.

FIGS. 4A-4D show another embodiment of the invention comprising a linear actuator 300. Linear actuator 300 is similar in many respects to linear actuator 100 described above and similar elements are labeled with similar reference numerals except that the leading numeral "1" has been replaced with a leading numeral "3". Except where indicated otherwise, actuator 300 may have features similar to corresponding features of actuator 100. Linear actuator 300 differs from linear actuator 100 primarily in the implementation of switch valves 350A, 350B and the resultant fluid pathways.

Figure 4A:
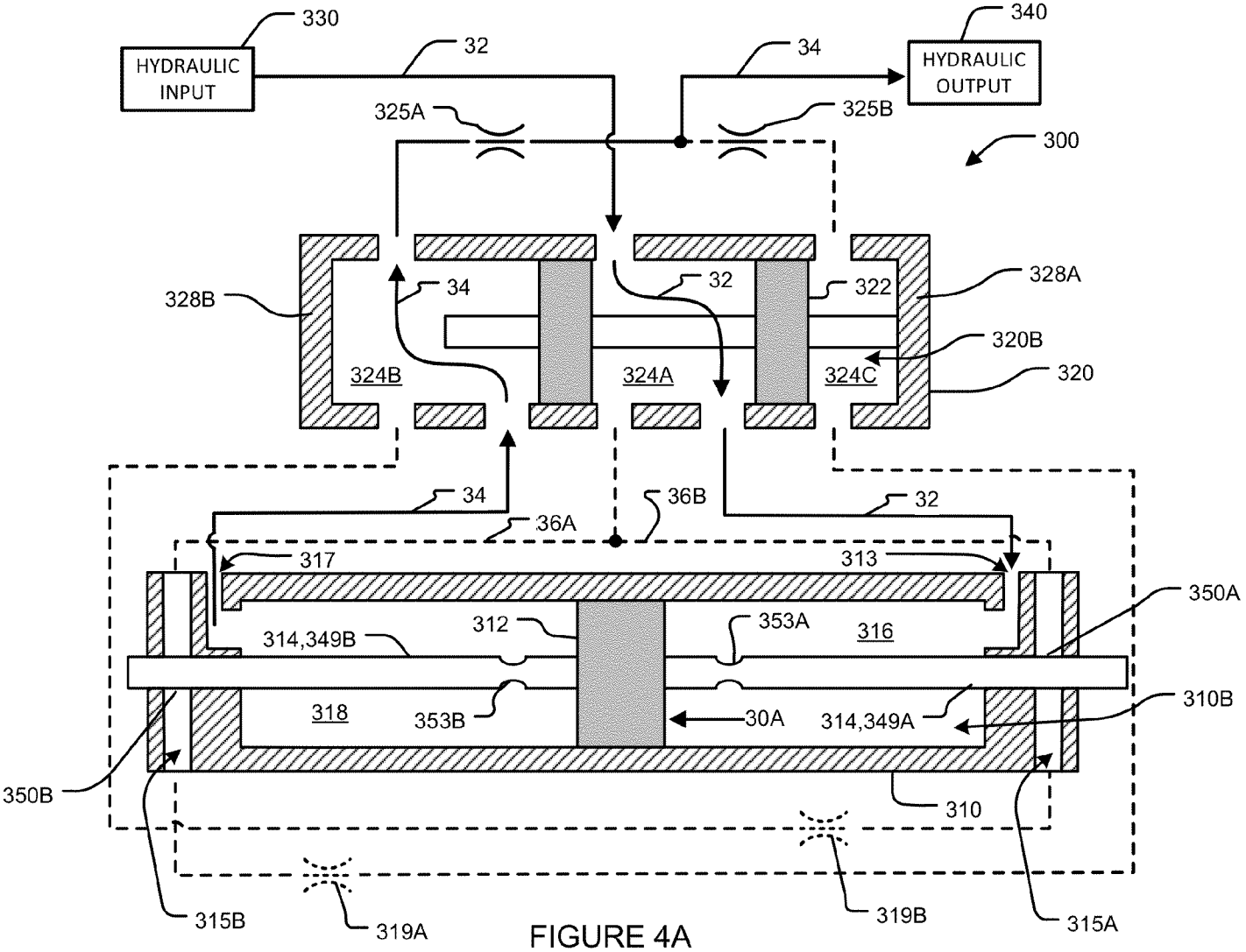
FIGS. 4A-4D show schematic views of various stages of a stroke cycle of a linear actuator according to another embodiment of the invention.

FIG. 4A shows piston 312 travelling in direction 30A at an arbitrary starting position in the middle of a piston stroke. In the illustrated embodiment, linear actuator 300 comprises a hydraulic linear actuator such that hydraulic input 330 provides hydraulic fluid to valve chamber 320 and piston chamber 310. In the configuration shown in FIG. 4A, spool valve 322 connects hydraulic input 330 to a first piston chamber port 313 such that input 330 is fluidly connected to piston chamber 310 along a fluid pathway indicated by arrows 32. Fluid pathway 32 permits fluid to flow through cavity portion 324A of valve chamber 320 into cavity portion 316 of piston chamber 310. In the cycle stage shown in FIG. 4A, first switch valve 350A and second switch valve 350B are in their closed configurations, blocking fluid pathways indicated by broken lines 36 between valve chamber 320 and piston chamber 310. In the FIG. 4A-4D embodiment, the moveable switching components 349A, 349B of switch valves 350A, 350B are both provided by piston rod 314 which is shaped to provide the seal which closes switch valves 350A, 350B and thereby blocks fluid flow in pathways 36. As explained in more detail below, in the FIG. 4A-4D embodiment, the moveable switching components 349A, 349B of switch valves 350A, 350B (i.e. piston rod 314) comprises switching features 353A, 353B which permit switch valves 350A, 350B to be configured in their open configurations.

Figure 4B:
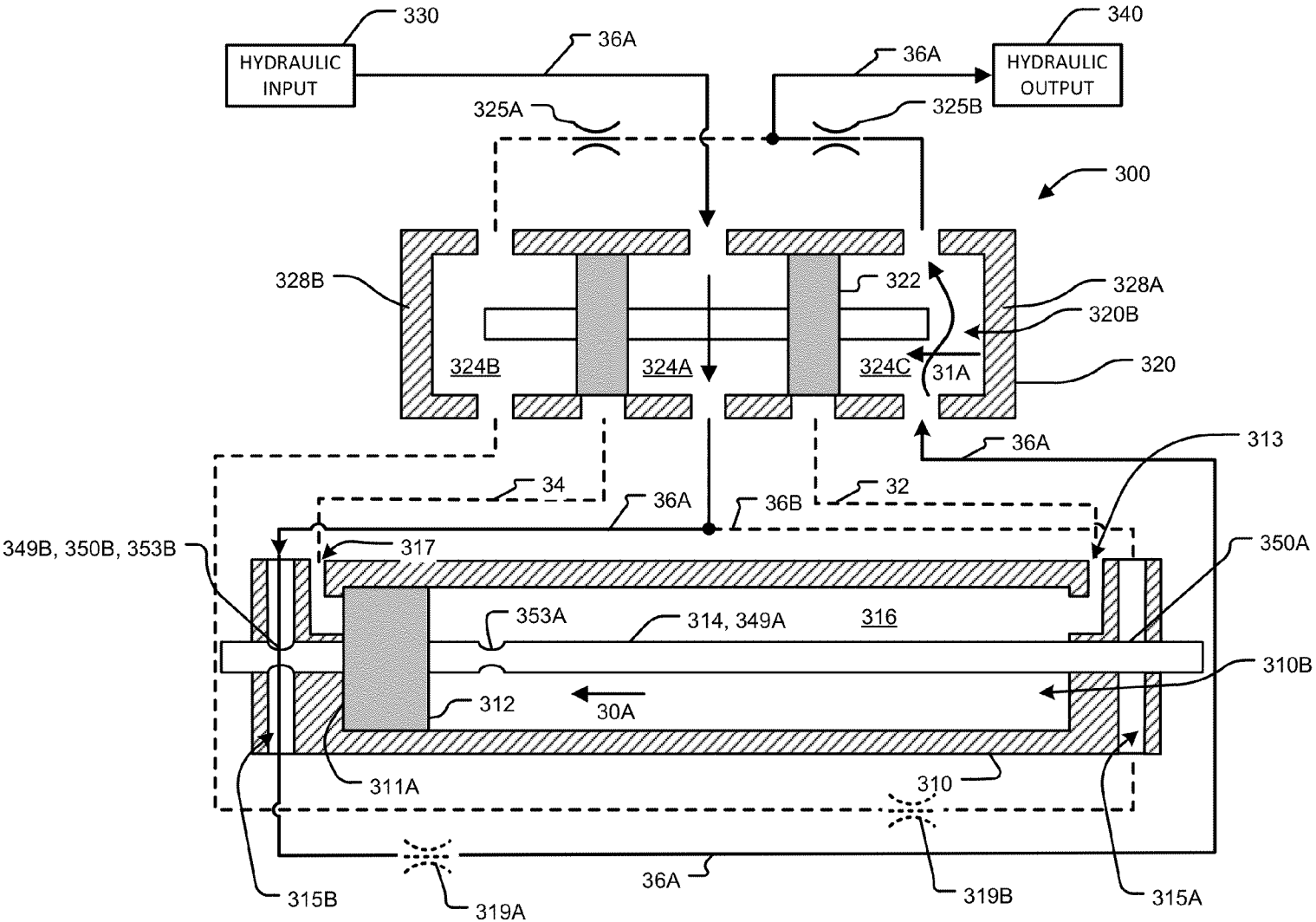

Fluid pathway 32 creates a differential pressure on a first side of piston 312 (i.e. in cavity portion 316) relative to the pressure on a second side of piston 312 (i.e. in cavity portion 318). The differential pressure causes piston 312 to travel in direction 30A until a first end of the piston stroke, as shown in FIG. 4B. As piston 312 travels in direction 30A, fluid is forced along fluid pathway 34 out of port 317 of piston chamber 310 into cavity portion 324B of valve chamber 320, through optional flow restrictor 325A and out to fluid output 340. In a manner similar to that discussed above in connection with linear actuator 100 of FIGS. 1A-1D, the fluid flow in pathway 34 creates a dynamic pressure in cavity portion 324B of valve camber 320 which tends to hold spool valve 322 in the configuration shown in FIG. 4A (i.e. against the rightward wall of valve chamber 320 in the illustrated view). This increase in pressure in cavity portion 324B relative to cavity portion 324C may be assisted by optional flow restrictor 325A and additionally or alternatively by suitable sizing of the input and output ports of cavity portion 324B, as discussed above.

FIG. 4B shows linear actuator 300 at the end of a piston stroke. Piston 312 has reached and abuts a first wall 311A of piston chamber 310, preventing additional movement of piston 312 and piston rod 314 in direction 30A. In the FIG. 4B configuration, second switch valve 350B is in its open configuration, wherein moveable switching component 349B (i.e. piston rod 314) has moved such that switching feature 353B on piston rod 314 is aligned with a corresponding short circuit channel 315B, thereby connecting fluid pathway 36A between cavity portions 324A and 324C of valve chamber 320. In the illustrated embodiment, switching feature 353B on piston rod 314 comprises a groove or concavity which extends around at least a portion of the perimeter (e.g. circumference) of piston rod 314. In some embodiments, switching feature 353B may comprise a full annular groove or concavity, although this is not necessary, and in some embodiments, switching feature 353B may comprise a semi-annular groove or concavity. In some embodiments, the flow around piston rod 314 is orthogonal to the piston rod axis, but this is not necessary and such flow may be at oblique angles relative to the piston rod axis. When switching feature 353B of the illustrated embodiment is aligned with corresponding short circuit channel 315B, fluid is permitted to flow through channel 315B around at least portion of the circumference of piston rod 314.

With fluid pathway 36A open through short circuit channel 315B, the fluid flow causes a dynamic pressure in cavity portion 324C of valve chamber 320 which causes spool valve 322 to move (e.g. shift axially) in direction 31A within valve chamber 320, thereby hydraulically moving (e.g. axially shifting) the configuration (e.g. position) of spool valve 322. In the illustrated embodiment, fluid pathway 36A includes an optional second flow restrictor 325B, which may help to increase the pressure of cavity portion 324C of valve chamber 320 relative to the now static pressure in cavity portion 324B of valve chamber 320. Additionally or alternatively, the output port of cavity portion 324C may be sized to be relatively small in comparison to the input port of cavity portion 324C to assist with the increase of pressure in cavity portion 324C. The static pressure in cavity portion 324B results from the cessation of fluid flow along fluid pathway 34 because piston 312 is no longer forcing fluid out of piston chamber 310 through port 317.

In addition to opening fluid pathway 36A, as spool valve 322 moves in direction 31A, fluid pathway 32 closes, disconnecting port 313 from hydraulic input 330. During this transition, flow to cavity portion 316 of piston chamber 310 from cavity portion 324A of valve chamber 320 decreases toward zero, while flow from cavity portion 324A of valve chamber 320 to cavity portion 324C of valve chamber 320 through switch valve 350B, short circuit channel 315B and fluid pathway 36A increases. Consequently, near the end of the piston stroke, the flow in fluid pathway 32 decreases, while the flow in fluid pathway 36A increases, thereby maintaining non-zero fluid flow through actuator 300 throughout the stroke cycle, minimizing flow blockages and associated pressure spikes.

Figure 4C:
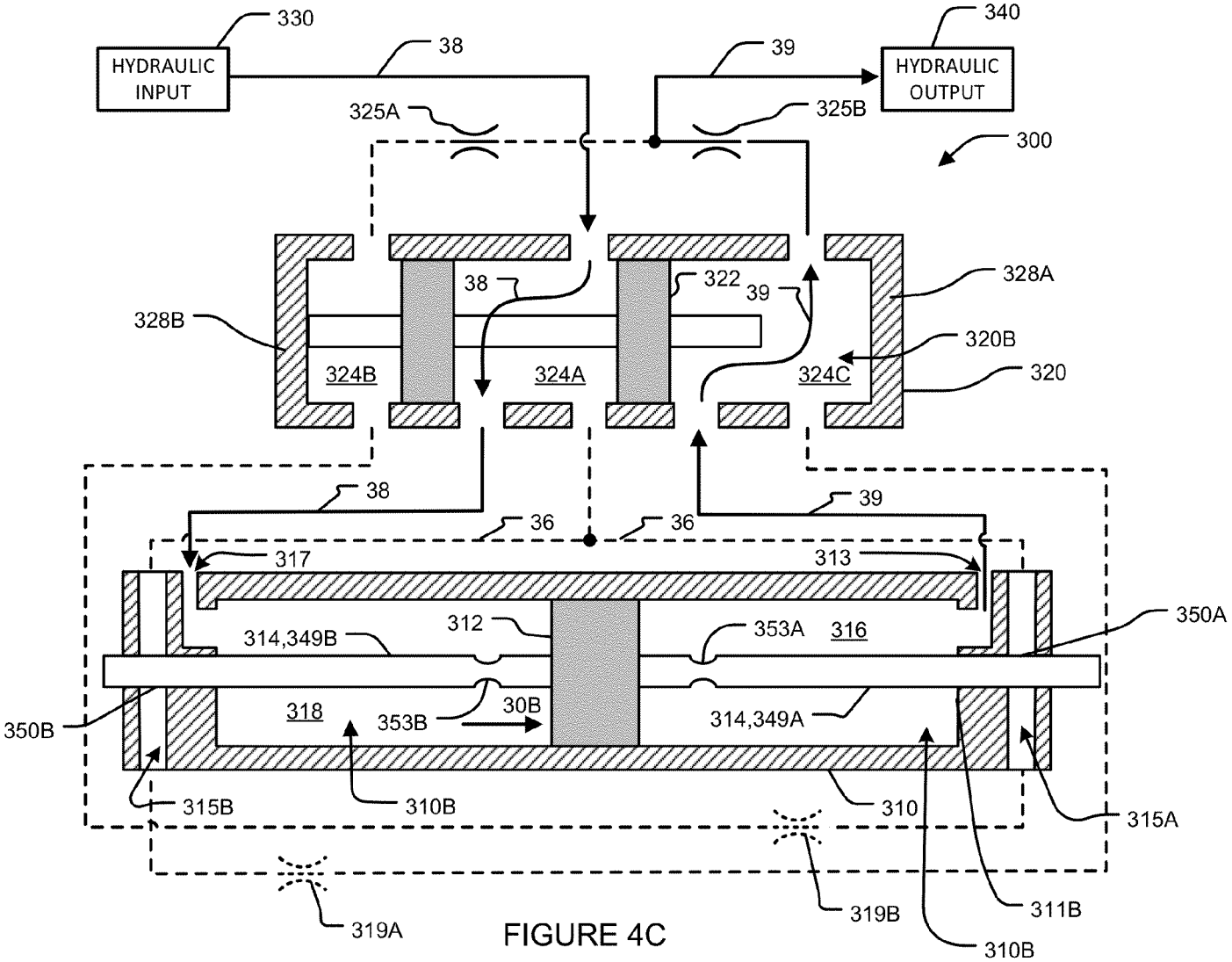

With the differential pressure between cavity portion 324C relative to cavity portion 324B, spool valve 322 continues to travel in direction 31A until it reaches the configuration shown in FIG. 4C, where (in the illustrated embodiment) spool valve 322 has reached its leftmost position in valve chamber 320 (e.g. in contact with second end wall 328B). In this configuration, spool valve 322 fluidly connects input 330 to cavity portion 318 of piston chamber bore 310B by way of a fluid pathway indicated by arrows 38. Fluid pathway 36A may be provided with one or more optional restrictions 319A at one or more corresponding locations between the output port of spool valve cavity portion 324A and the input port of spool valve cavity portion 324C for building pressure which may encourage fluid flow in fluid pathway 38 when spool valve 322 has reached the FIG. 4C configuration, but piston 312 has initially not yet moved from its FIG. 4B configuration. In the illustrated embodiment, restriction 319A is shown between switch valve 350B and the input port of spool valve cavity portion 324C, but this is not necessary. In some embodiments, restriction 319A may be at one or more other locations on fluid pathway 36A between the output port of spool valve cavity portion 324A and the input port of spool valve cavity portion 324C. In some embodiments, restriction 319A may be provided by short circuit conduit 315B and/or by the path through switch valve 350B.

Once spool valve 322 and piston 312 are in the FIG. 4C configuration, fluid flows along fluid pathway 38 from input 330 into cavity portion 324A of valve chamber 320, exiting valve chamber 320 into piston chamber 310 through port 317 and into cavity portion 318 of piston chamber bore 310B. Similarly to the configuration of FIG. 4A but in the opposite direction 30B, fluid entering cavity portion 318 of piston chamber bore 310B forces piston 312 to travel in direction 30B by exerting pressure on piston 312. As piston 312 moves in direction 30B, switching feature 353B gradually moves away from short circuit path 315B and second switch valve 350B gradually closes. Also, fluid from cavity portion 316 of piston chamber bore 310B is returned to output 340 via a fluid pathway 39. Fluid in fluid pathway 39 is pushed out of cavity portion 316 of piston chamber 310 exiting piston chamber 310 via port 313, passing through cavity portion 324C of valve chamber 320, and returning to hydraulic output 340.

The flow through cavity portion 324C of valve chamber 320 creates a dynamic pressure which helps to maintain spool valve 322 in the illustrated configuration of FIG. 4C. Also, in the case of the illustrated embodiment, the flow of fluid to outlet 340 through optional flow restriction 325B may help to increase the pressure in cavity portion 324C of valve chamber bore 320 relative to cavity portion 324B of valve chamber bore 320 which may also help to hold spool valve 322 in the FIG. 4C configuration. Additionally or alternatively, the output port of cavity portion 324C may be made relatively small in comparison to the input port of cavity portion 324C to help build back pressure in cavity portion 324C and to thereby help to hold spool valve 322 in the FIG. 4C configuration. In this phase of the stroke cycle, piston 312 continues to travel in direction 30B until piston 312 reaches second wall 311B.

Figure 4D:
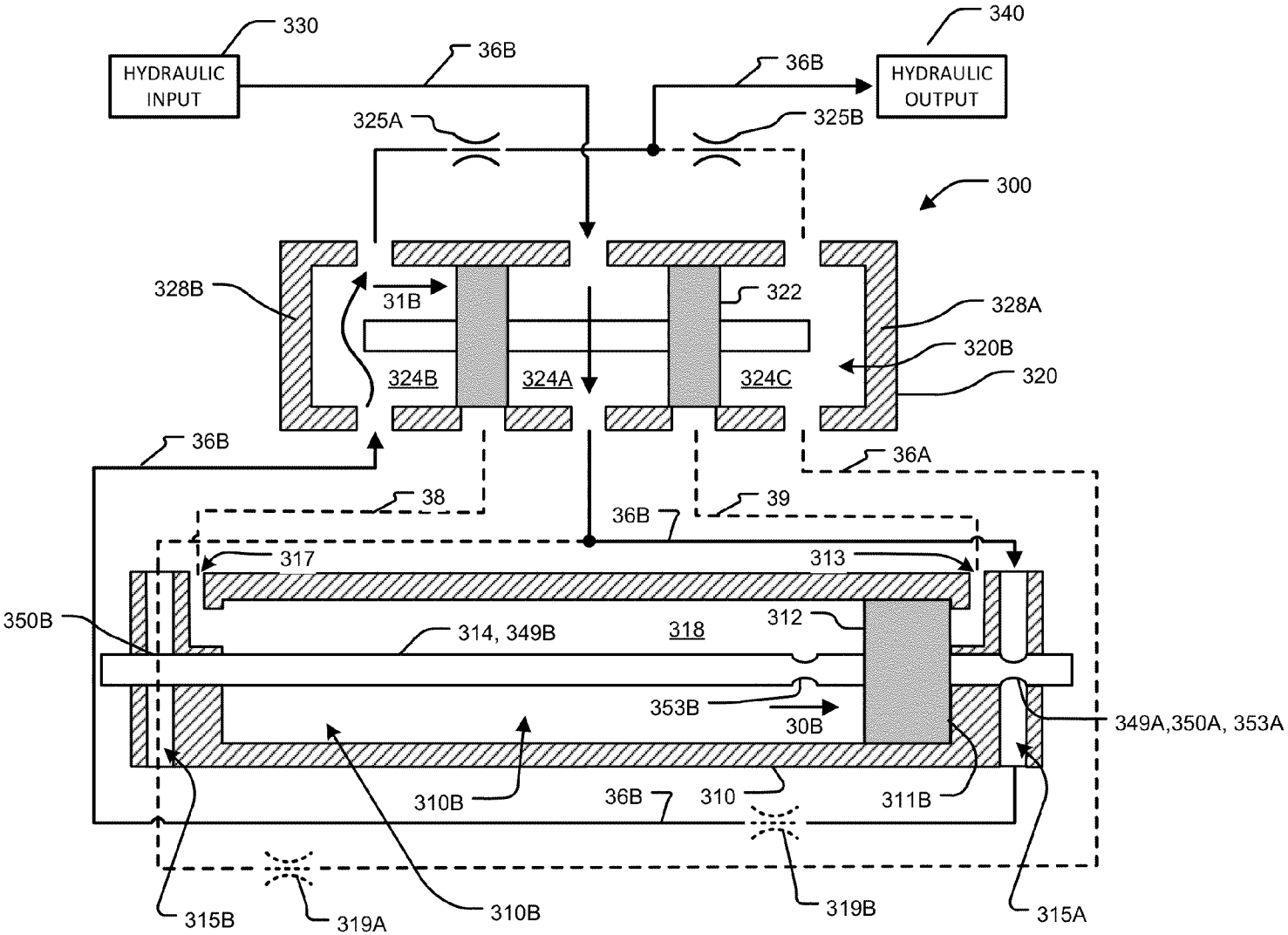

FIG. 4D shows linear actuator 300 as piston 312 moves in direction 30B toward the end of its piston stroke. When linear actuator 300 approaches the end of its stroke, first switch valve 350A reaches its open configuration (FIG. 4D), wherein moveable switching component 349A (i.e. piston rod 314) has moved such that switching feature 353A on piston rod 314 is aligned with a corresponding short circuit channel 315A, thereby connecting fluid pathway 36B between cavity portions 324A and 324B of valve chamber 320. In the illustrated embodiment, switching feature 353A on piston rod 314 comprises a groove or concavity which extends around at least a portion of the perimeter (e.g. circumference) of piston rod 314 and which has features similar to those of switching feature 353B discussed above. When switching feature 353A of the illustrated embodiment is aligned with corresponding short circuit channel 315A, fluid is permitted to flow through channel 315A around at least portion of the circumference of piston rod 314.

In fluid pathway 36B, fluid flows from hydraulic input 330, into cavity portion 324A of valve chamber 320, short circuiting through short-circuit channel 315A, returning to valve chamber 320 and into cavity portion 324B, and returning to fluid output 340. In the illustrated embodiment, short-circuit channels 315 bypass piston chamber bore 310B but form part of piston chamber 310. In some embodiments, fluid in short circuit channels 315 may be caused to bypass piston chamber 310 altogether, or may pass through piston chamber bore 310B.

With fluid pathway 36B open, the fluid flow causes a dynamic pressure in cavity portion 324B of valve chamber bore 320B which is relatively high in comparison to the static pressure in cavity portion 324C and which causes spool valve 322 to travel in direction 31B within valve chamber bore 320B, thereby hydraulically moving (e.g. axially shifting) the configuration (e.g. position) of spool valve 322. In the illustrated embodiment, fluid pathway 36B includes an optional first flow restriction 325A between the output port of cavity portion 324B and output 340, which can create a back pressure which may help to increase the pressure in cavity portion 324B. Additionally or alternatively, the output port of cavity portion 324B may be sized to be relatively small in comparison to the input port of cavity portion 324B to help increase the pressure in cavity portion 324B relative to cavity portion 324C. This increase in pressure in cavity portion 324B of valve chamber bore 320B relative to the now static pressure in cavity portion 324C of valve chamber bore 320B moves spool valve 322 in direction 31B. The static pressure in cavity portion 324C results from the cessation of fluid flow along fluid pathway 39 because piston 312 is no longer forcing fluid out of piston chamber 310 through port 313.

In addition to switch valve 350A opening fluid pathway 36B, as spool valve 322 moves (e.g. axially shifts) in direction 31B in valve chamber 320 (FIG. 4D), spool valve 322 closes the fluid pathway 38, disconnecting port 317 from hydraulic input 330. During this transition, flow of fluid from valve chamber cavity portion 324A to cavity portion 318 of piston chamber bore 310B decreases toward zero, while flow from cavity portion 324A of valve chamber 320 to cavity portion 324B of valve chamber 320 through switch valve 350A, short circuit channel 315A and fluid pathway 36B increases. Consequently, near the end of the piston stroke, the flow in fluid pathway 38 decreases, while the flow in fluid pathway 36B increases, thereby maintaining non-zero fluid flow through actuator 100 throughout the stroke cycle, minimizing flow blockages and associated pressure spikes.

With the differential pressure between cavity portion 324B relative to cavity portion 324C, spool valve 322 continues to travel in direction 31B until it reaches the configuration shown in FIG. 4A, where (in the illustrated embodiment) spool valve 322 has reached its rightmost position in valve chamber 320 (e.g. in contact with first end wall 328A). In this configuration, spool valve 322 fluidly connects input 330 to cavity portion 316 of piston chamber bore 310B by way of fluid pathway 32 as discussed above. Fluid pathway 36B may be provided with one or more optional restrictions 319B at one or more corresponding locations between the output port of spool valve cavity portion 324A and the input port of spool valve cavity portion 324B for building pressure which may encourage fluid flow in fluid pathway 32 when spool valve 322 has reached the FIG. 4A configuration, but piston 312 has initially not yet moved from its FIG. 4D configuration. In the illustrated embodiment, restriction 319B is shown between switch valve 350A and the input port of spool valve cavity portion 324B, but this is not necessary. In some embodiments, restriction 319B may be at one or more other locations on fluid pathway 36B between the output port of spool valve cavity portion 324A and the input port of spool valve cavity portion 324B. In some embodiments, restriction 319B may be provided by short circuit conduit 315A and/or by the path through switch valve 350A.

Figure 5A:
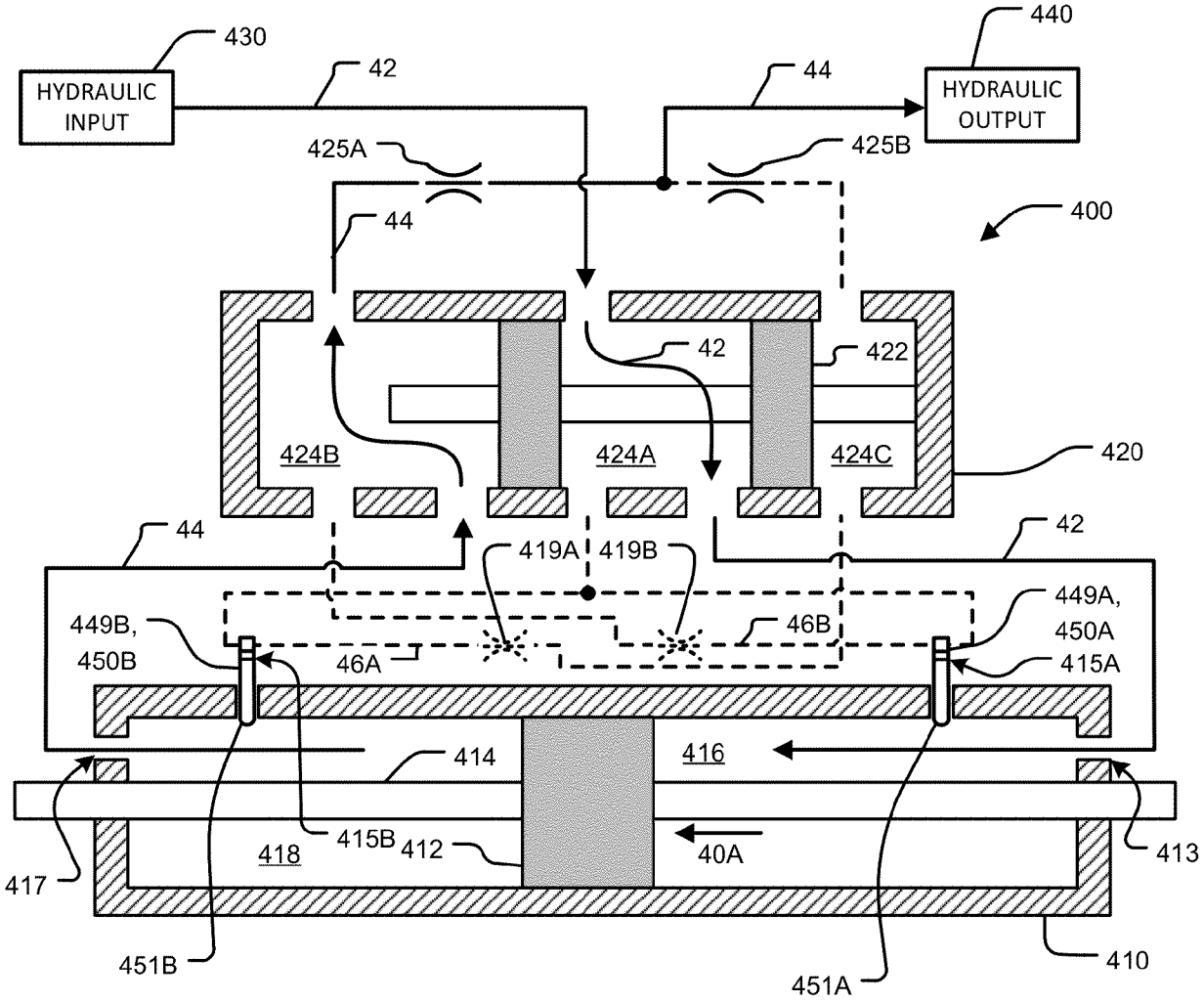
FIGS. 5A and 5B show schematic views of various stages of a stroke cycle of a linear actuator according to another embodiment of the invention.
Figure 5B:
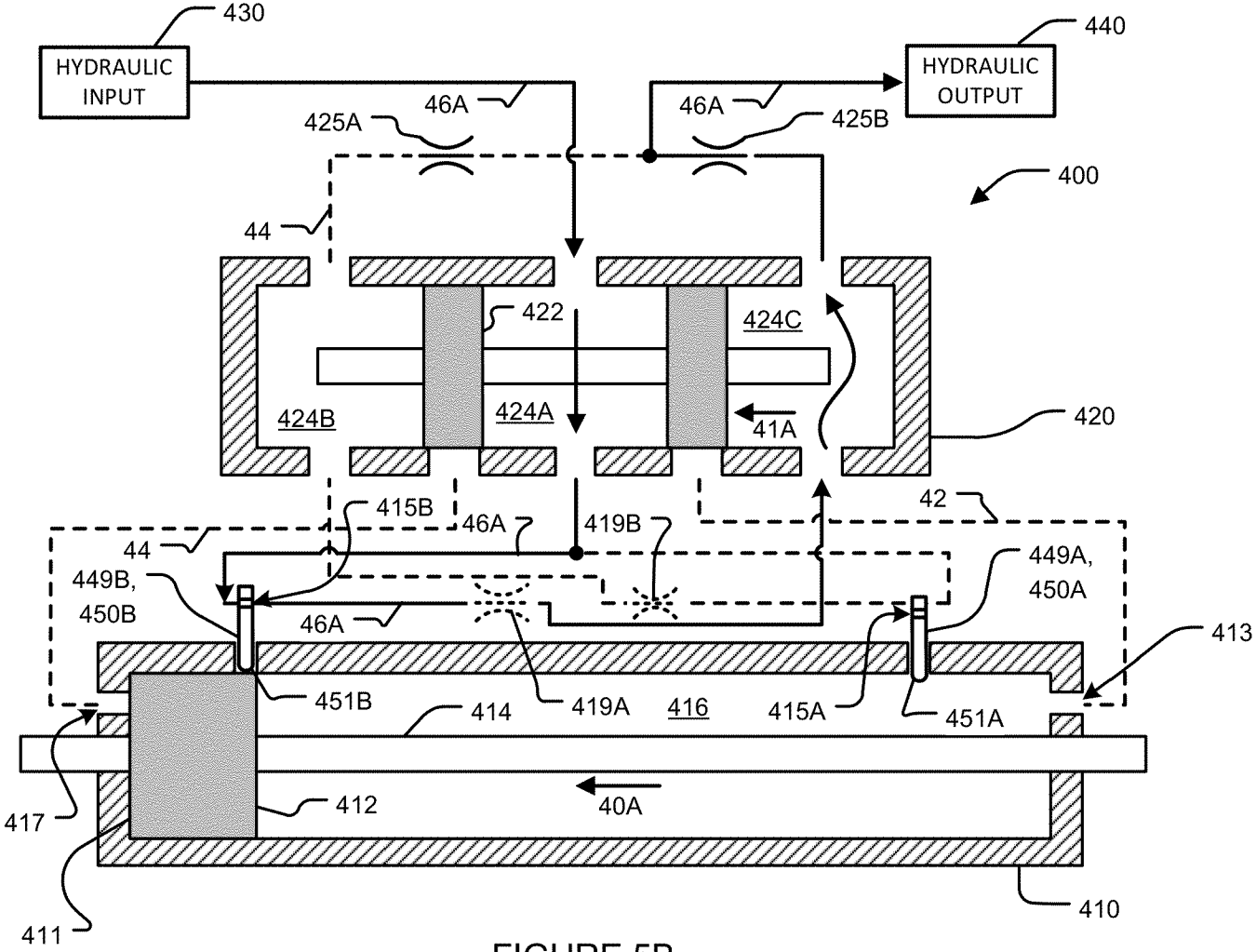

FIGS. 5A and 5B show another embodiment of the invention comprising a linear actuator 400. Linear actuator 400 is similar in many respects to linear actuator 100 described above and similar elements are labeled with similar reference numerals except that the leading numeral "1" has been replaced with a leading numeral "4". Except where indicated otherwise, actuator 400 may have features similar to corresponding features of actuator 100. Linear actuator 400 differs from linear actuator 100 primarily in the configuration of switch valves 450A, 450B and the resultant fluid pathways.

FIG. 5A shows piston 412 travelling in direction 40A at an arbitrary starting position in the middle of a piston stroke. In the illustrated embodiment, linear actuator 400 comprises a hydraulic linear actuator such that hydraulic input 430 provides hydraulic fluid to valve chamber 420 and piston chamber 410. In the configuration shown in FIG. 5A, spool valve 422 connects hydraulic input 430 to a first piston chamber port 413 such that input 430 is fluidly connected to piston chamber 410 along a fluid pathway indicated by arrows 42. Fluid pathway 42 permits fluid to flow through cavity portion 424A of valve chamber 420 into cavity portion 416 of piston chamber 410. In the cycle stage shown in FIG. 5A, first switch valve 450A and second switch valve 450B are in their closed configurations, blocking fluid pathways indicated by broken lines 46 between valve chamber 420 and piston chamber 410. In the FIGS. 5A and 5B embodiment, switch valves 450A, 450B comprise moveable switching components 449A, 449B having through-ports 415A, 415B. In the FIG. 5A configuration, moveable switching components 449A, 449B are positioned such that through-ports 415A, 415B are not aligned with fluid pathways 46, so fluid pathways 46 are closed.

Fluid pathway 42 creates a differential pressure on a first side of piston 412 (i.e. in cavity portion 416) relative to the pressure on a second side of piston 412 (i.e. in cavity portion 418). The differential pressure causes piston 412 to travel in direction 40A until a first end of the piston stroke, as shown in FIG. 5B. As piston 412 travels in direction 40A, fluid is forced along fluid pathway 44 out of port 417 of piston chamber 410 into cavity portion 424B of valve chamber 420, through optional flow restrictor 425A and out to fluid output 440. In a manner similar to that discussed above, when actuator 400 is in the configuration shown in FIG. 5A, the dynamic pressure in cavity portion 424B of valve chamber 420 maintains spool valve 422 in the configuration shown in FIG. 5A (e.g. against the rightward wall of valve chamber 420 in the illustrated view).

FIG. 5B shows linear actuator 400 at the end of a piston stroke. Piston 412 has reached and abuts a first wall 411 of piston chamber 410, preventing additional movement of piston 412 and piston rod 414 in direction 40A. In the FIG. 5B configuration, piston 412 has engaged and switched second switch valve 450B to an open configuration, wherein through-port 415B is aligned with fluid pathway 46A, thereby connecting fluid pathway 46A between cavity portions 424A and 424C of valve chamber 420. More particularly, piston 412 has engaged and displaced moveable switching component 449B such that through-port 415B is aligned with fluid pathway 46A, thereby connecting fluid pathway 46A between cavity portions 424A and 424C of valve chamber 420. In the embodiment of FIGS. 5A and 5B, moveable switching components 449A, 449B of switch valves 450A, 450B are mechanically displaced in directions offset or otherwise different than (i.e. non-co-axial with) the axial direction of the piston stroke. In the particular case of the illustrated embodiment, moveable switching components 449A, 449B of switch valves of 450A, 450B are mechanically displaced in directions orthogonal to the axial direction of the piston stroke. In some embodiments, moveable switching components 449A, 449B of switch valves 450A, 450B may be oriented such that they are mechanically displaced at oblique angles relative to the axial direction of the piston stroke. In some embodiments, moveable switching components 449A, 449B of switch valves 450A, 450B may be provided with a suitably oriented engagement surface to effect this displacement. In the particular case of the illustrated embodiment, moveable switching components 449A, 449B of switch valves 450A, 450B comprise rounded engagement surfaces 451A, 451B. In other embodiments, moveable switching components 449A, 449B of switch valves 450A, 450B may comprise beveled engagement surfaces that effect similar displacements in directions offset from (i.e. non-co-axial with) the axial direction of the piston stroke. In some embodiments, piston 412 may also be provided with a similarly shaped (e.g. round, beveled or the like) engagement surface. In the illustrated embodiment, moveable switching components 449A, 449B of switch valves 450A, 450B are actuated by mechanical interaction with piston 412. In some embodiments, piston rod 414 may be provided with suitable switching features (e.g. convexities or concavities) which may mechanically interact with moveable switching components 449A, 449B of switch valves 450A, 450B to configure switch valves 450A, 450B between their open and closed configurations.

With fluid pathway 46A open (as is the case in FIG. 5B), the fluid flow causes a dynamic pressure in cavity portion 424C which is relatively high in comparison to the static pressured in cavity portion 424B and which causes spool valve 422 to move in direction 41A within valve chamber 420, thereby hydraulically moving (e.g. axially shifting) the configuration (e.g. position) of spool valve 422. In the illustrated embodiment, fluid pathway 46A includes an optional flow restrictor 425B, which may help to create the increased pressure in cavity portion 424C of valve chamber 420 relative the now static pressure in cavity portion 424B of valve chamber 420. Additionally or alternatively, the size of the valve chamber ports in cavity portion 424C may be configured to help to increase this back pressure. The static pressure in cavity portion 424B results from the cessation of fluid flow along fluid pathway 44 because piston 412 is no longer forcing fluid out of piston chamber 410 through port 417.

In addition to switch valve 450B opening fluid pathway 46A, as spool valve 422 moves in direction 41A, fluid pathway 42 closes, disconnecting port 413 from hydraulic input 430. During this transition, flow of fluid from valve chamber cavity portion 424A to cavity portion 416 of piston chamber 410 decreases toward zero, while flow from cavity portion 424A of valve chamber 420 to cavity portion 424C of valve chamber 420 through switch valve 450B, short circuit channel 415B and fluid pathway 46A increases. Consequently, near the end of the piston stroke, the flow in fluid pathway 42 decreases while the flow in fluid pathway 46A increases, thereby maintaining non-zero fluid flow through actuator 400 throughout the stroke cycle, minimizing flow blockages and associated pressure spikes.

Spool valve 422 continues to travel in direction 41A until it reaches a configuration where it is at the end of its travel in valve chamber 420 (e.g. to its leftmost position in the illustrated embodiment). In this configuration, spool valve 422 fluidly connects input 430 to cavity portion 418 of piston chamber bore 410B by way of a fluid pathway that is the reverse of path 44 (shown in FIG. 5A). Fluid pathway 46A may be provided with one or more optional restrictions 419A at one or more corresponding locations between the output port of spool valve cavity portion 424A and the input port of spool valve cavity portion 424C which may function in a manner similar to and may be implemented in a manner similar to restrictions 119, 319 discussed above. When spool valve 422 is in this configuration, spool valve 422 creates a differential pressure in cavity portion 418 of piston chamber 410 relative to cavity portion 416 of piston chamber 410 and continues the automatically repeating stroke cycle of linear actuator 400 in a manner similar to that described above for linear actuators 100, 300.

Figure 6A:
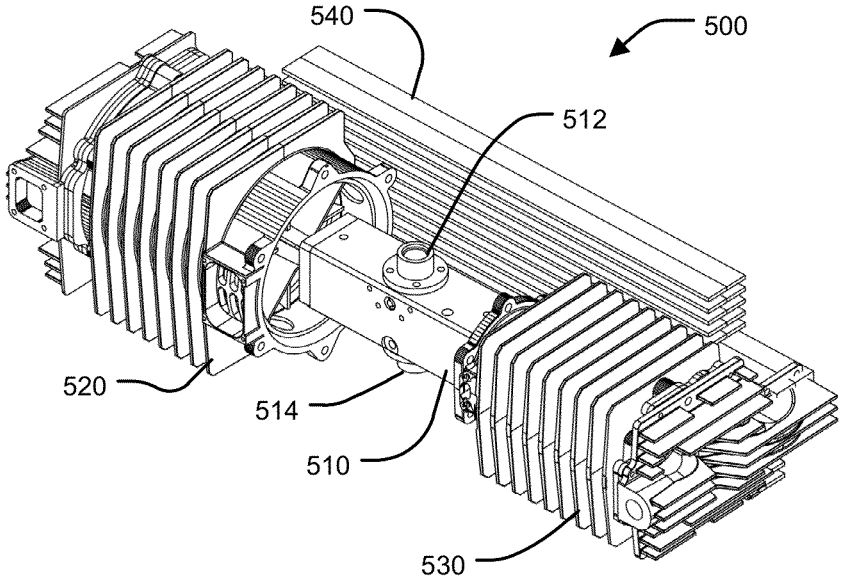
FIG. 6A shows a perspective view of a compact air compressor according to an embodiment of the invention.

Linear actuators described herein may be used in a variety of applications. For example, one particular embodiment provides for use of the linear actuator in a portable air compressor 500 as shown in FIG. 6A. Air compressor 500 is a hydraulic linear multi-stage air compressor comprising a linear actuator 510 (which may comprise any of the linear actuators described herein), a low pressure chamber 520, a high pressure chamber 530, and an intercooler 540. FIG. 6A shows a hydraulic input 512 and a hydraulic output 514 of linear actuator 510.

Figure 6B:
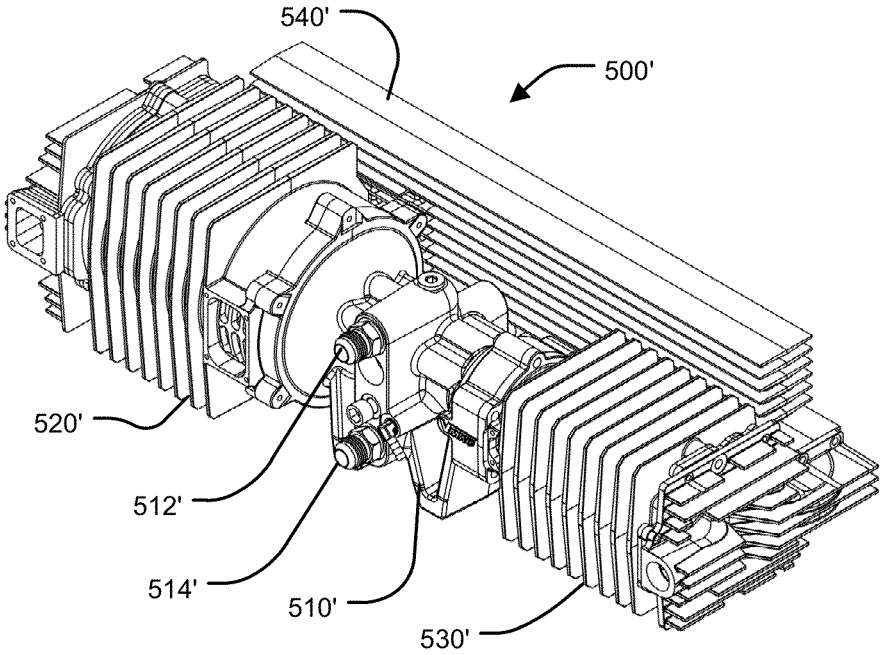
FIG. 6B shows a perspective view of a compact air compressor according to an embodiment of the invention.

Another embodiment provides a portable air compressor 500' as shown in FIG. 6B. Air compressor 500' is a hydraulic linear multi-stage air compressor comprising a linear actuator 510' (which may comprise any of the linear actuators described herein), a low pressure chamber 520', a high pressure chamber 530', and an intercooler 540'. FIG. 6B shows a hydraulic input 512' and a hydraulic output 514' of linear actuator 510'. The details of dual-stage air compressors and their implementation are known in the art.

While a number of exemplary aspects and embodiments are discussed herein, those of skill in the art will recognize certain modifications, permutations, additions and sub-combinations thereof. For example:

Fluid linear actuators according to various embodiments of the invention may use fluids other than conventional hydraulic fluids. By way of non-limiting example, such fluids could be compressible fluids, such as air or some other type of gas, or generally non-compressible fluids. In this description and the accompanying claims when a component is being described as "hydraulically" moving or being moved "hydraulically", it should be understood to encompass fluid-actuated movement (e.g. caused by differential fluid pressure), whether such fluid is compressible or non-compressible.

The piston may mechanically actuate a pilot spool that controls the spool valve, which controls the fluid flow to the piston chamber.

In the embodiments of FIGS. 1 and 4 described above, the moveable switching components move in directions that are axially aligned with the piston axis. In the embodiment of FIG. 5 described above, the moveable switching components move in directions that are orthogonally and/or obliquely oriented relative to the piston axis. In other embodiments (not shown), it is possible to provide switch valves comprising moveable switching components similar to those of the FIG. 5 embodiment, but which move in directions that are parallel to the piston axis and also offset from the piston axis.

In the above-described embodiments, a pair of switch valves are provided each with a pair of corresponding configurations. In other embodiments, a different number of switch valves could be provided. For example, a single switch valve could be provided with a different number (e.g. four) configurations which could be used to hydraulically move the spool valve.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A fluid-driven linear actuator comprising:

a piston configured for reciprocating motion in a bore defined by a piston chamber;

a spool valve in a valve chamber, the valve chamber fluidly connected to a fluid input and to a fluid output, the spool valve configured to be hydraulically moved within the valve chamber between a plurality of spool valve configurations, the plurality of spool valve configurations comprising a first spool valve configuration wherein the valve chamber is fluidly connected to the piston chamber to thereby create a first fluid pressure differential which tends to force the piston in a first axial direction in the piston chamber and a second spool valve configuration wherein the valve chamber is fluidly connected to the piston chamber to thereby create a second fluid pressure differential which tends to force the piston in a second axial direction in the piston chamber; and a first switch valve located on a first axial side of the piston and a second switch valve located on a second axial side of the piston and wherein each of the first and second switch valves is configured to be switchable between a plurality of switch valve configurations by the reciprocating motion of the piston and to thereby create one or more differential pressure configurations which hydraulically move the spool valve;

wherein the spool valve is held, between extremes of the reciprocating motion of the piston, in at least one of the plurality of spool valve configurations by fluid pressure, and wherein the first and second switch valves comprise first and second intersections of first and second fluid conduit channels with a piston rod, the piston rod coupled to the piston or integrally formed with the piston for axial movement therewith, the piston rod comprising a first groove at a first axial location and a second groove at a second axial location;

wherein alignment of the first groove with the first fluid conduit channel creates a relatively high pressure of at least one of the one or more differential pressure configurations which hydraulically move the spool valve.

2. An actuator according to claim 1 comprising a restriction located in a fluid path between an outlet of the valve chamber and a fluid reservoir, the restriction creating a dynamic pressure differential thereacross and wherein the spool valve is held in the at least one of the plurality of spool valve configurations, between extremes of the reciprocating motion of the piston, by fluid pressure associated with the dynamic pressure differential.

3. An actuator according to claim 1 wherein the first switch valve is configured to be switchable to a first open switch valve configuration which permits fluid flow through a first fluid pathway and thereby creates a corresponding first differential pressure configuration which hydraulically moves the spool valve toward the first spool valve configuration.

4. An actuator according to claim 3 wherein the second switch valve is configured to be switchable to a second open switch valve configuration which permits fluid flow through a second fluid pathway and thereby creates a corresponding second differential pressure configuration which hydraulically moves the spool valve toward the second spool valve configuration.

5. An actuator according to claim 4 wherein the first switch valve is configured to be switchable to a first closed switch valve configuration which blocks fluid flow through the first fluid pathway, thereby creating a corresponding third differential pressure configuration which exerts fluidic pressure which tends to hold the spool valve in the first spool valve configuration.

6. An actuator according to claim 5 wherein the second switch valve is configured to be switchable to a second closed switch valve configuration which blocks fluid flow through the second fluid pathway, thereby creating a corresponding fourth differential pressure configuration which exerts fluidic pressure which tends to hold the spool valve in the second spool valve configuration.

7. An actuator according to claim 5 wherein the third differential pressure configuration comprises a flow-induced dynamic fluidic differential pressure which tends to hold the spool valve in the first spool valve configuration.

8. An actuator according to claim 4 wherein at least a portion of the first fluid pathway is connected to permit fluid flow through the piston chamber bore and at least a portion of the second fluid pathway is connected to permit fluid flow through the piston chamber bore.

9. An actuator according to claim 4 wherein the first fluid pathway is connected to permit fluid flow only external to the piston chamber bore and the second fluid pathway is connected to permit fluid flow only external to the piston chamber bore.

10. An actuator according to claim 4 wherein a first portion of the piston rod comprises a first outwardly opening groove on its perimeter surface for permitting fluid flow in the groove and around the portion of the perimeter of the first portion of the piston rod when the first switch valve is in the first open switch valve configuration and a second portion of the piston rod comprises a second outwardly opening groove on its perimeter surface for permitting fluid flow in the groove and around the portion of the perimeter of the second portion of the piston rod when the second switch valve is in the second open switch valve configuration.

11. An actuator according to claim 10 wherein a first direction of the fluid flow around the portion of the perimeter of the first portion of the piston rod and a second direction of the fluid flow around the portion of the perimeter of the second portion of the piston rod are oriented either: generally orthogonally to the first and second axial directions or at an oblique angle relative to the first and second axial directions.

12. An actuator according to claim 1 wherein a first portion of the piston rod comprises a recessed groove at an axial location thereon and wherein the first switch valve is switchable between a first one of the plurality of switch valve configurations when the groove is axially aligned with the corresponding fluid conduit channel and a second one of the plurality of switch valve configurations when the groove is out of axial alignment with the corresponding fluid conduit channel.

13. An actuator according to claim 1 wherein a first portion of the piston rod comprises a first switching feature at an axial location thereon and wherein the plurality of switch valve configurations comprises a first open switch valve configuration when the first switching feature is axially aligned with the corresponding fluid conduit channel, the first open switch valve configuration permitting fluid flow through a first fluid pathway and thereby creating a corresponding first differential pressure configuration which hydraulically moves the spool valve toward the first spool valve configuration.

14. An actuator according to claim 13 wherein the plurality of switch valve configurations comprises a first closed switch valve configuration when the first switching feature is out of axial alignment with the corresponding fluid conduit channel, the first closed switch valve configuration blocking fluid flow through the first fluid pathway and permitting fluid flow into the piston chamber on a first axial side of the piston and out of the piston chamber from a second axial side of the piston, thereby creating a corresponding second differential pressure configuration which exerts fluidic pressure which tends to hold the spool valve in the first spool valve configuration.

15. An actuator according to claim 13 wherein a second portion the piston rod comprises a second switching feature at an axial location thereon and wherein the plurality of switch valve configurations comprises a second open switch valve configuration when the second switching feature is axially aligned with the corresponding fluid conduit channel, the second open switch valve configuration permitting fluid flow through a second fluid pathway and thereby creating a corresponding third differential pressure configuration which hydraulically moves the spool valve toward the second spool valve configuration.

16. An actuator according to claim 15 wherein the plurality of switch valve configurations comprises a second closed switch valve configuration when the second switching feature is out of axial alignment with the corresponding fluid conduit channel, the second closed switch valve configuration blocking fluid flow through the second fluid pathway and permitting fluid flow into the piston chamber on a second axial side of the piston and out of the piston chamber from a second axial side of the piston, thereby creating a corresponding fourth differential pressure configuration which exerts fluidic pressure which tends to hold the spool valve in the first spool valve configuration.

17. An actuator according to claim 1 comprising one or more flow restrictors fluidly connected between the valve chamber and the fluid output for helping to create at least one of the one or more differential pressure configurations which hydraulically move the spool valve.

18. An actuator according to claim 1 where the valve chamber and the piston chamber are axially offset.

19. An actuator according to claim 1 wherein an axial dimension of the piston is less than an axial piston stroke length.

20. An actuator according to claim 1 wherein a second portion of the piston rod comprises a recessed groove at an axial location thereon and wherein the second valve is switchable between a first one of the plurality of switch valve configurations when the groove is axially aligned with the corresponding fluid conduit channel and a second one of the plurality of switch valve configurations when the groove is out of axial alignment with the corresponding fluid conduit channel.

* * * * *